US012504216B2

(12) United States Patent
Park et al.

(10) Patent No.: US 12,504,216 B2
(45) Date of Patent: Dec. 23, 2025

(54) REFRIGERATOR

(71) Applicant: LG ELECTRONICS INC., Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 167 days.

(21) Appl. No.: 18/019,941

(22) PCT Filed: Jul. 19, 2021

(86) PCT No.: PCT/KR2021/009263
§ 371 (c)(1),
(2) Date: Feb. 6, 2023

(87) PCT Pub. No.: WO2022/030811
PCT Pub. Date: Feb. 10, 2022

(65) Prior Publication Data

US 2023/0288125 A1 Sep. 14, 2023

(30) Foreign Application Priority Data

Aug. 6, 2020 (KR) ..... 10-2020-0098366

(51) Int. Cl.
*F25D 21/02* (2006.01)

(52) U.S. Cl.
CPC ..... *F25D 21/02* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS

| | | | | | |
|---|---|---|---|---|---|
| 3,355,904 | A * | 12/1967 | Sutton, Jr. | G05D 11/13 | 73/196 |
| 5,460,010 | A * | 10/1995 | Kobayashi | F25D 17/065 | 62/154 |
| 5,934,088 | A * | 8/1999 | Takeda | F25B 49/005 | 62/127 |
| 9,127,875 | B2 * | 9/2015 | Hall | F25D 21/006 | |
| 9,557,091 | B1 * | 1/2017 | Zardo | F25D 23/061 | |
| 2005/0281669 | A1 * | 12/2005 | Sohn | F04D 29/422 | 415/204 |
| 2009/0113923 | A1 * | 5/2009 | Young | F25D 17/065 | 700/282 |
| 2011/0011106 | A1 * | 1/2011 | Ahn | F25D 17/065 | 62/441 |
| 2018/0031298 | A1 * | 2/2018 | Kim | F25D 25/025 | |

FOREIGN PATENT DOCUMENTS

| | | | |
|---|---|---|---|
| WO | 2019/164084 | A1 | 8/2019 |
| WO | 2019/172497 | A1 | 12/2019 |

* cited by examiner

*Primary Examiner* — Joel M Attey
*Assistant Examiner* — Meraj A Shaikh
(74) *Attorney, Agent, or Firm* — Bryan Cave Leighton Paisner LLP

(57) ABSTRACT

A refrigerator includes a flow path exit of a fluid introduction part and a flow path entrance of the frost detection duct that have a same size. Thus, defrost water flowing down into the fluid introduction part through a guide flow path may more efficiently flow downward without becoming stagnant and freezing of the stagnant water may be prevented.

17 Claims, 38 Drawing Sheets

【Figure 1】
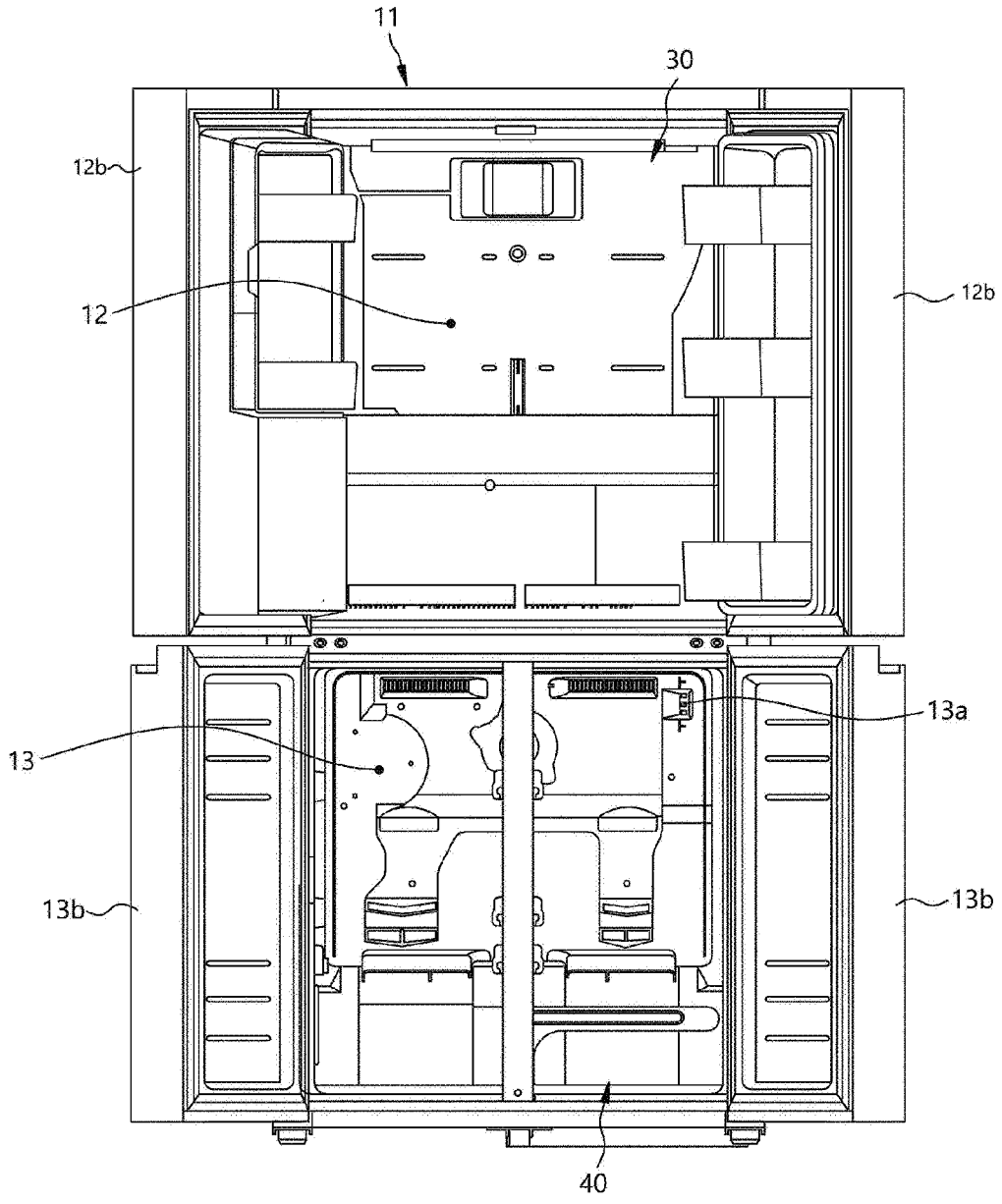

【Figure 2】
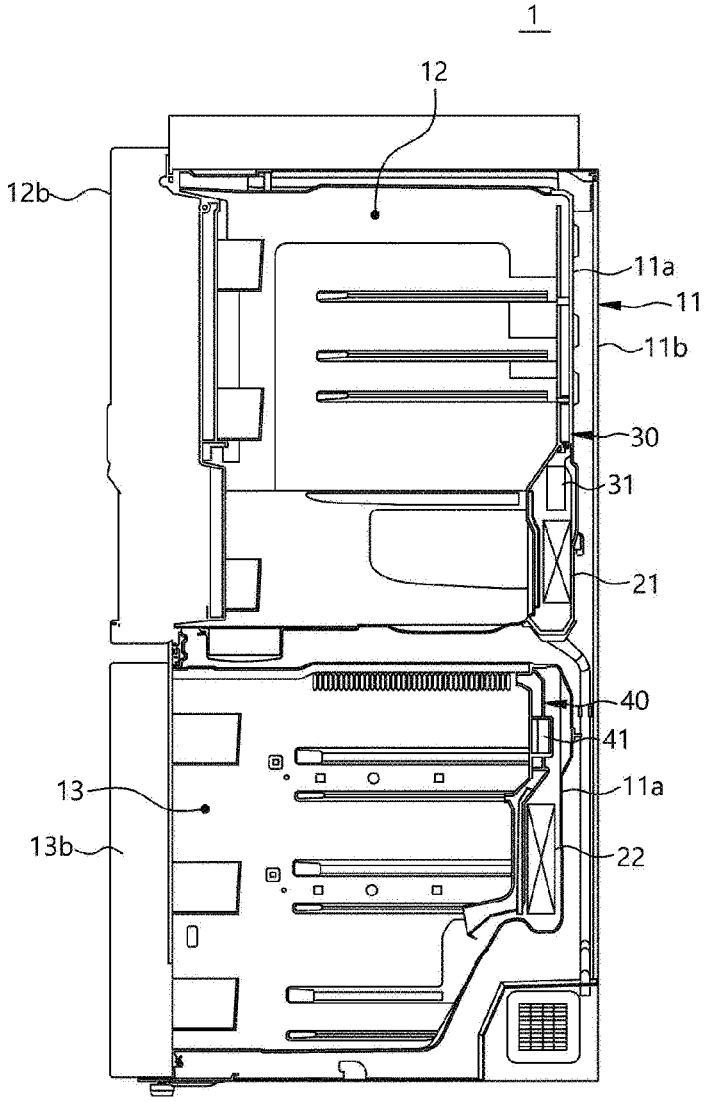

【Figure 3】
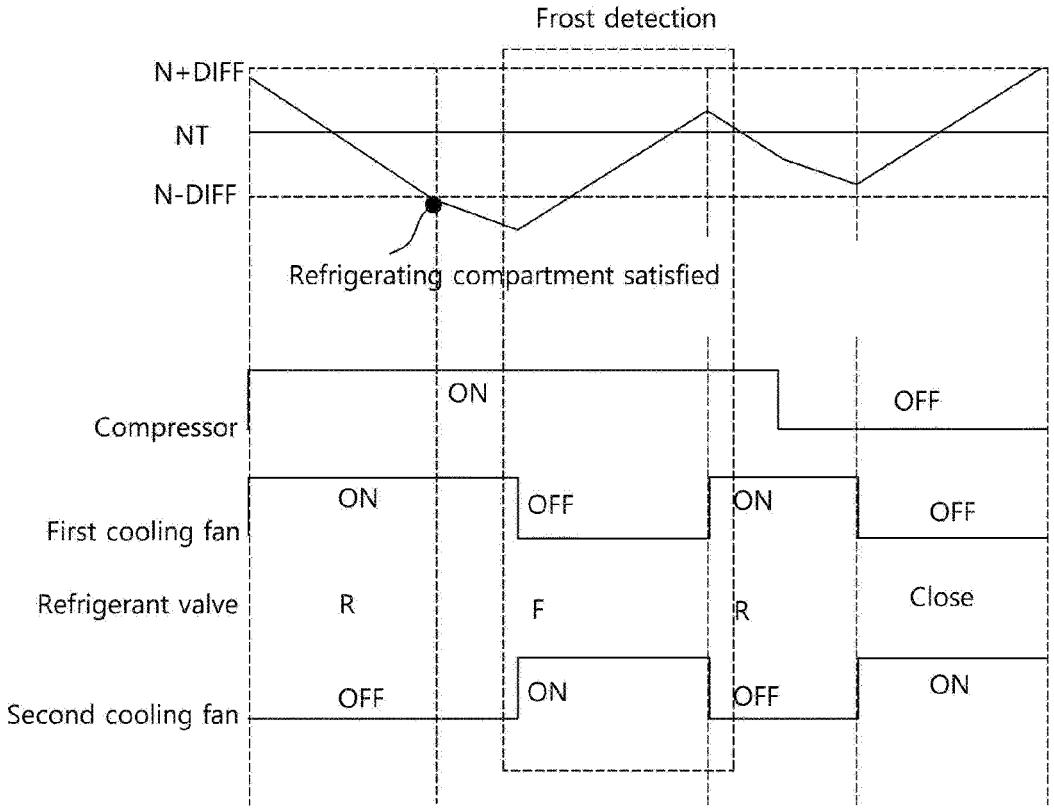

【Figure 4】
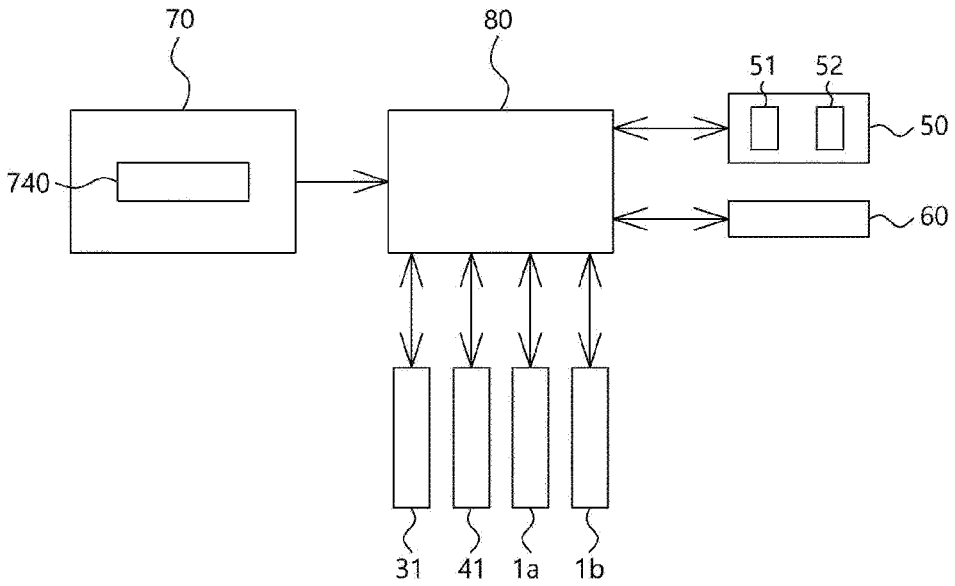
【Figure 5】
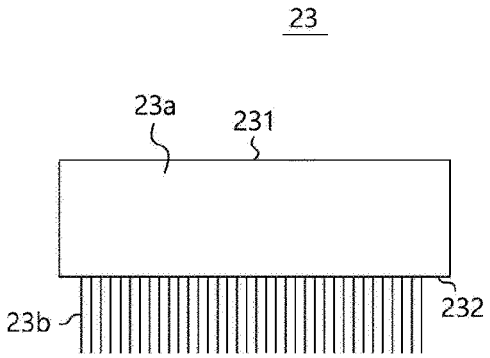

【Figure 6】
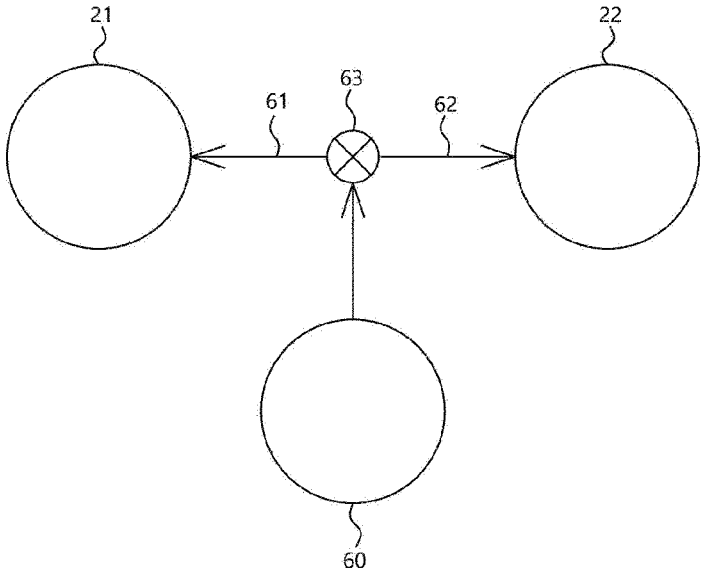

【Figure 7】
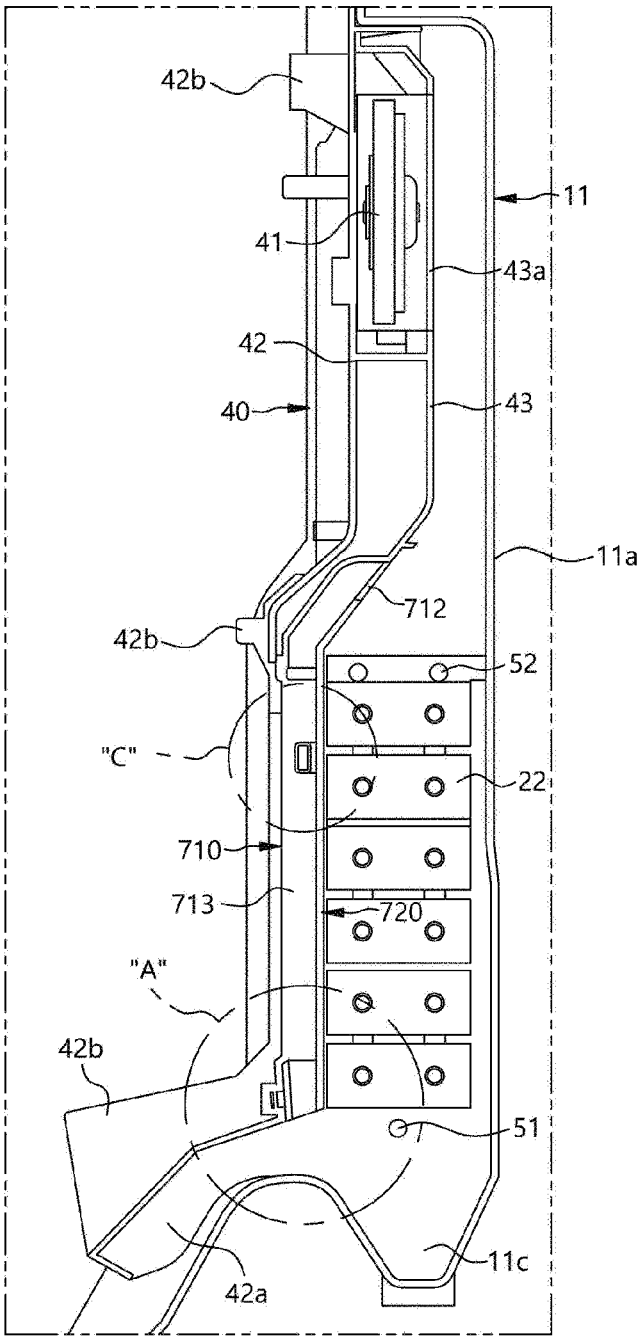

【Figure 8】
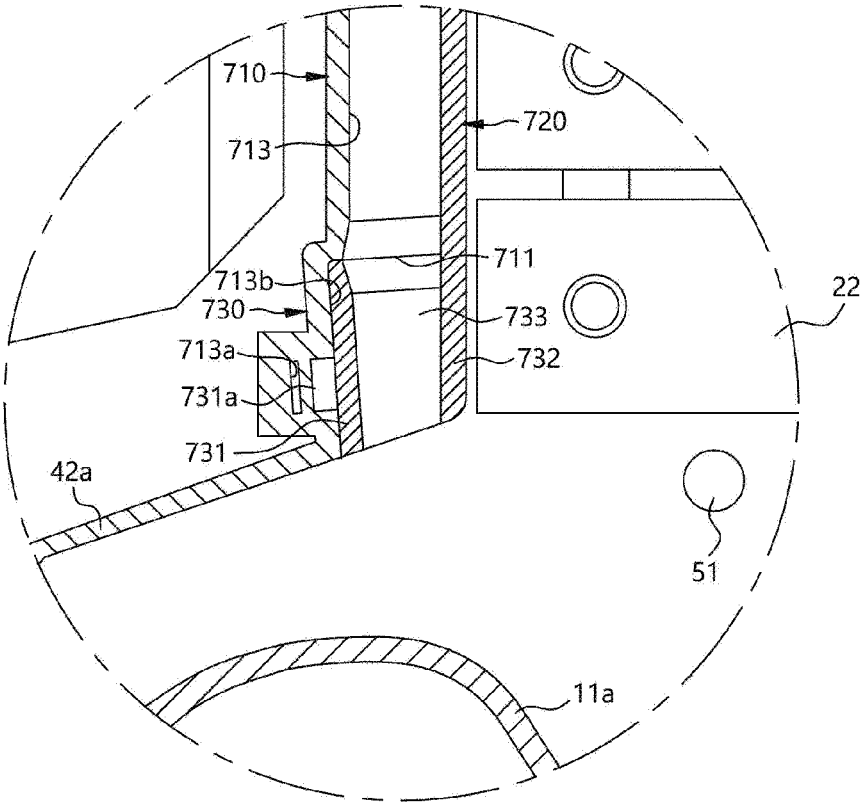

【Figure 9】
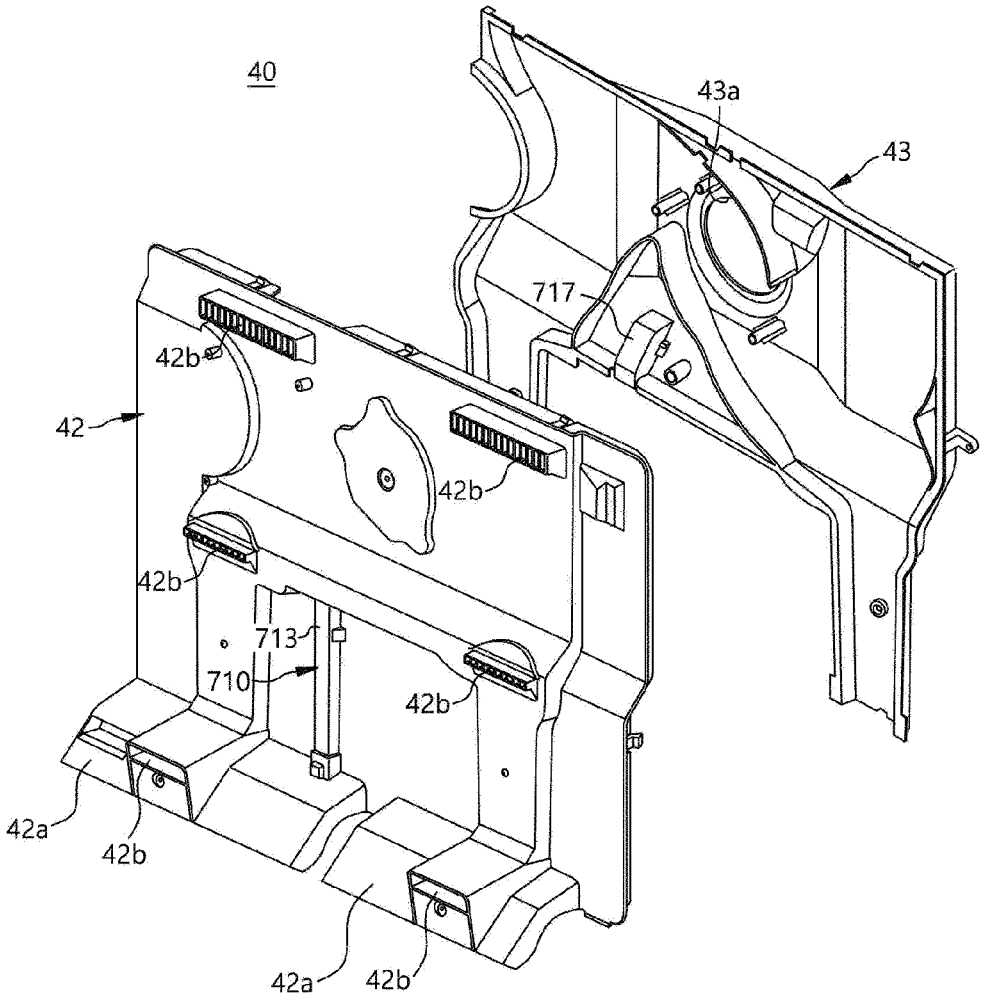

【Figure 10】
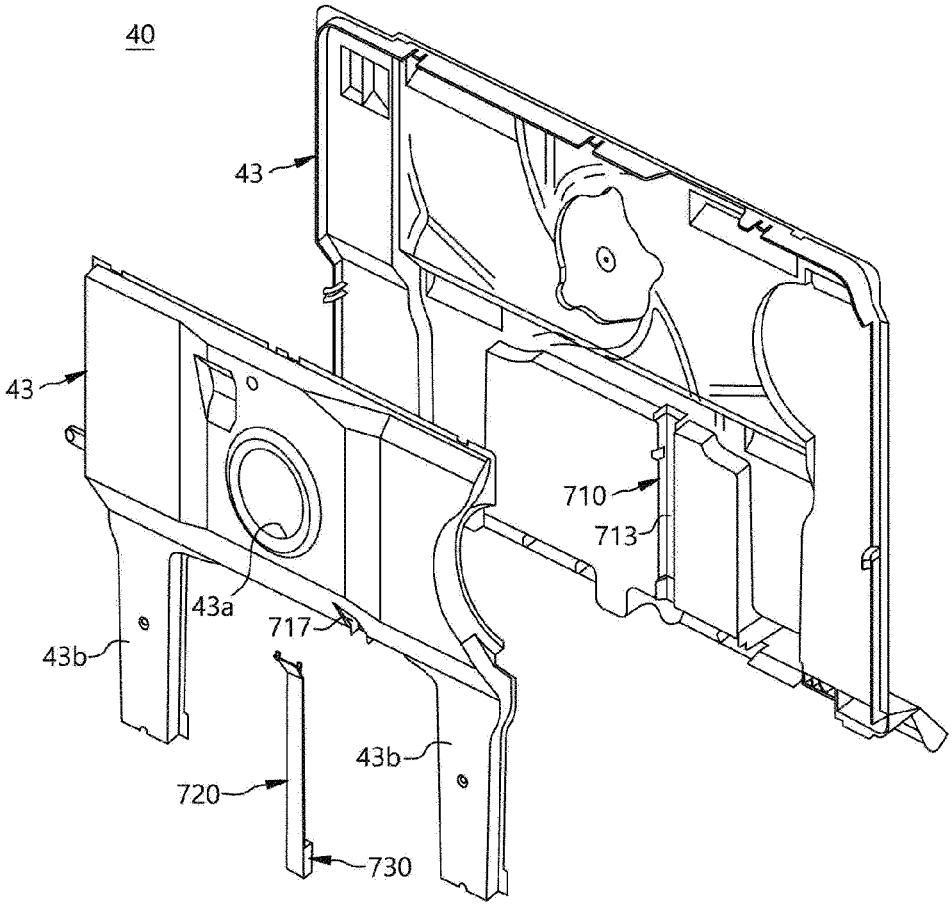

【Figure 11】
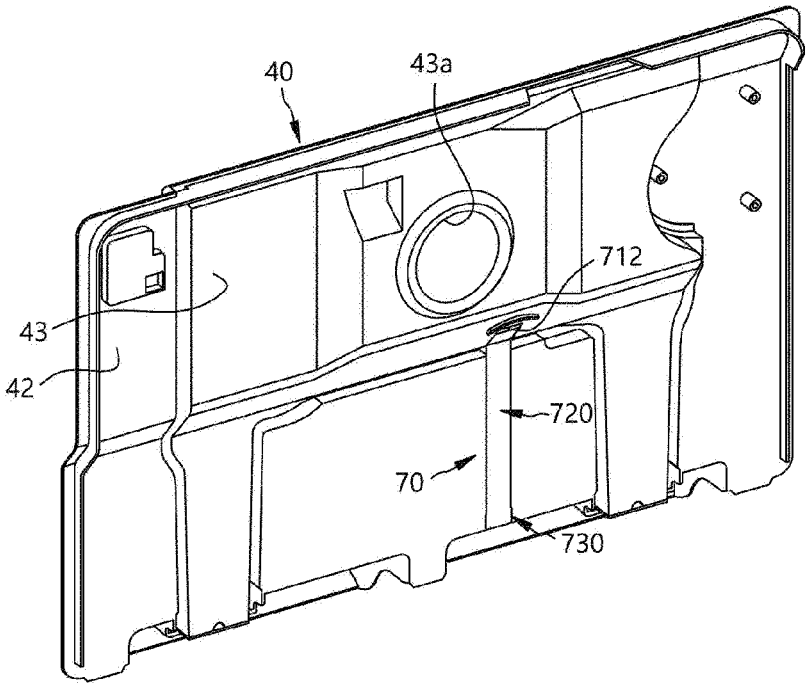

【Figure 12】
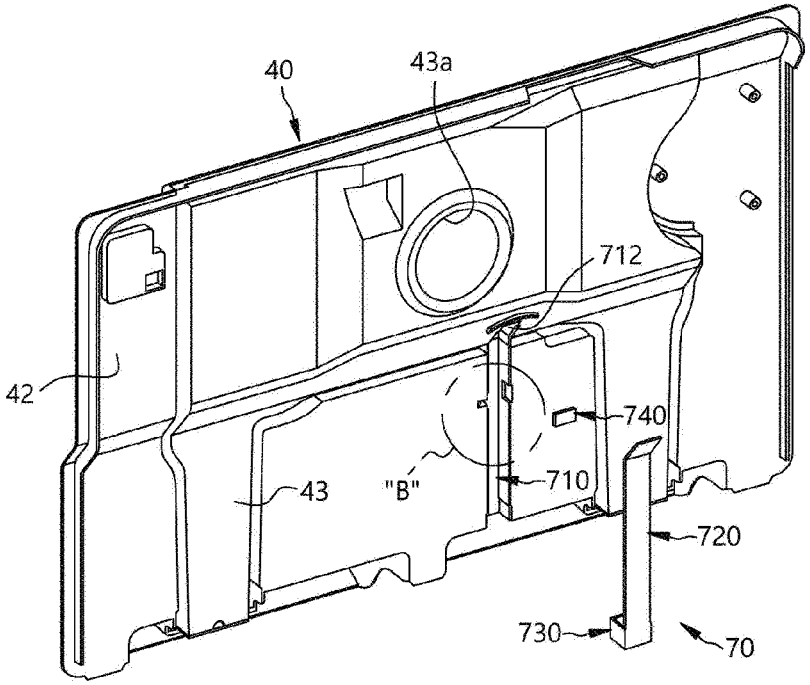

【Figure 13】
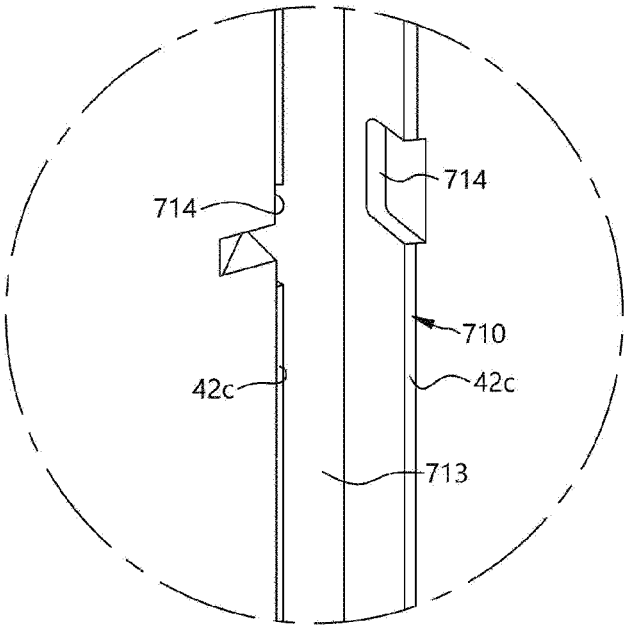

【Figure 14】
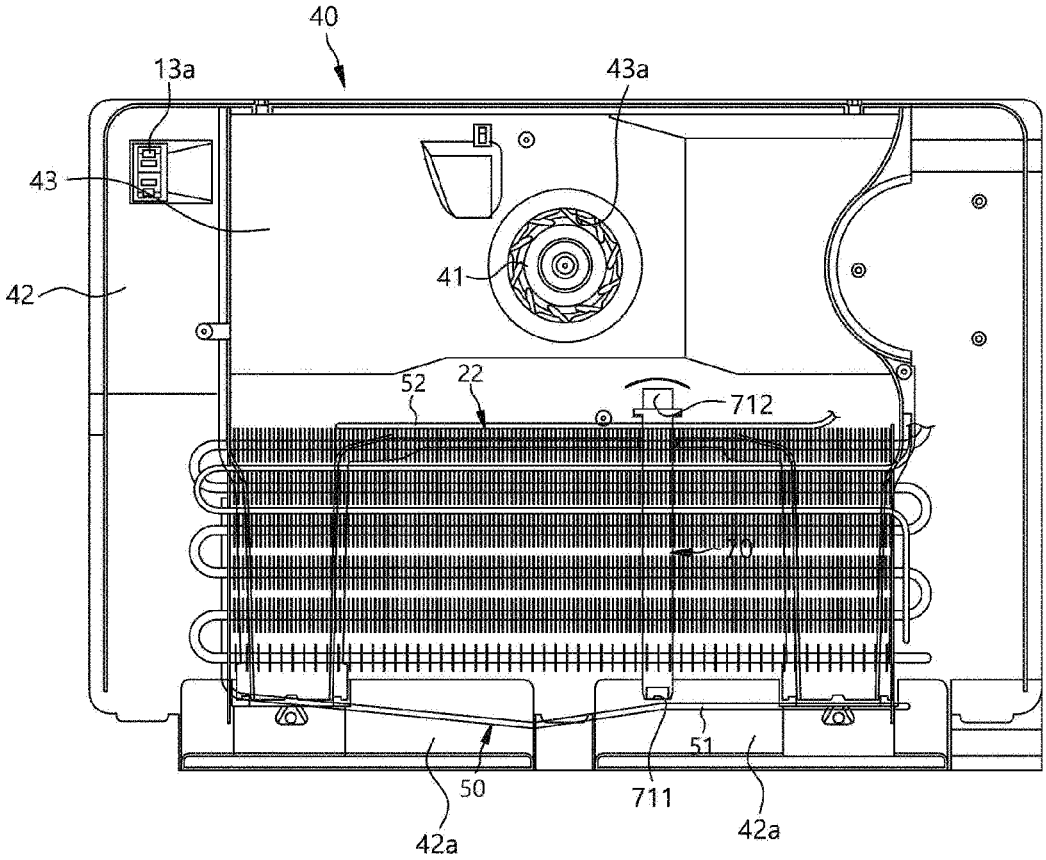

【Figure 15】
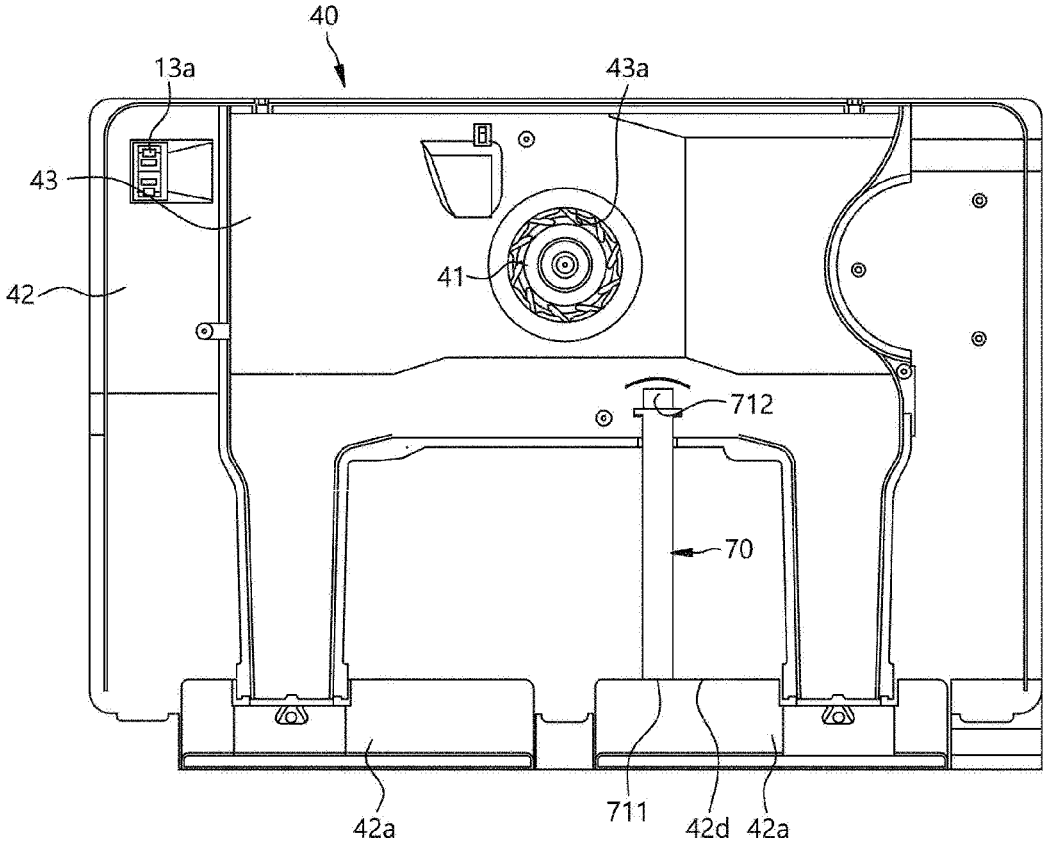

【Figure 16】
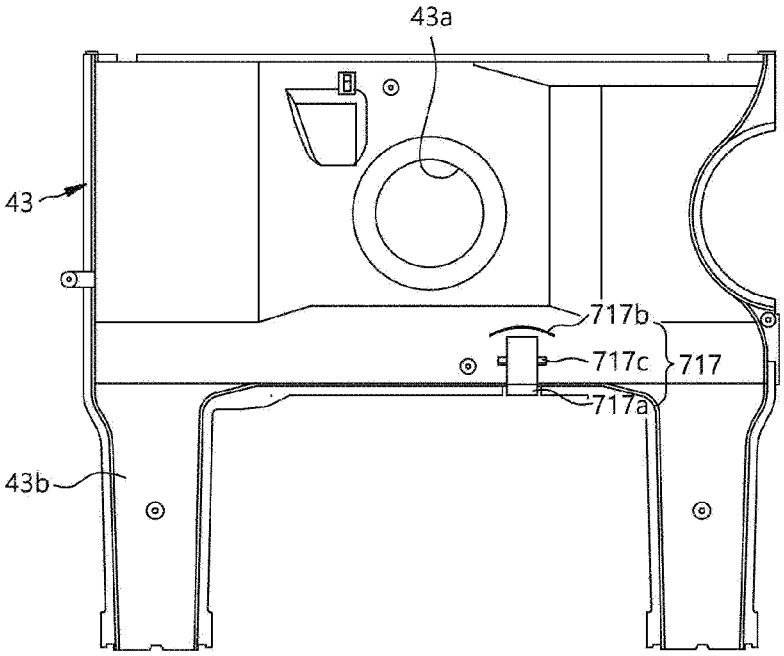

【Figure 17】
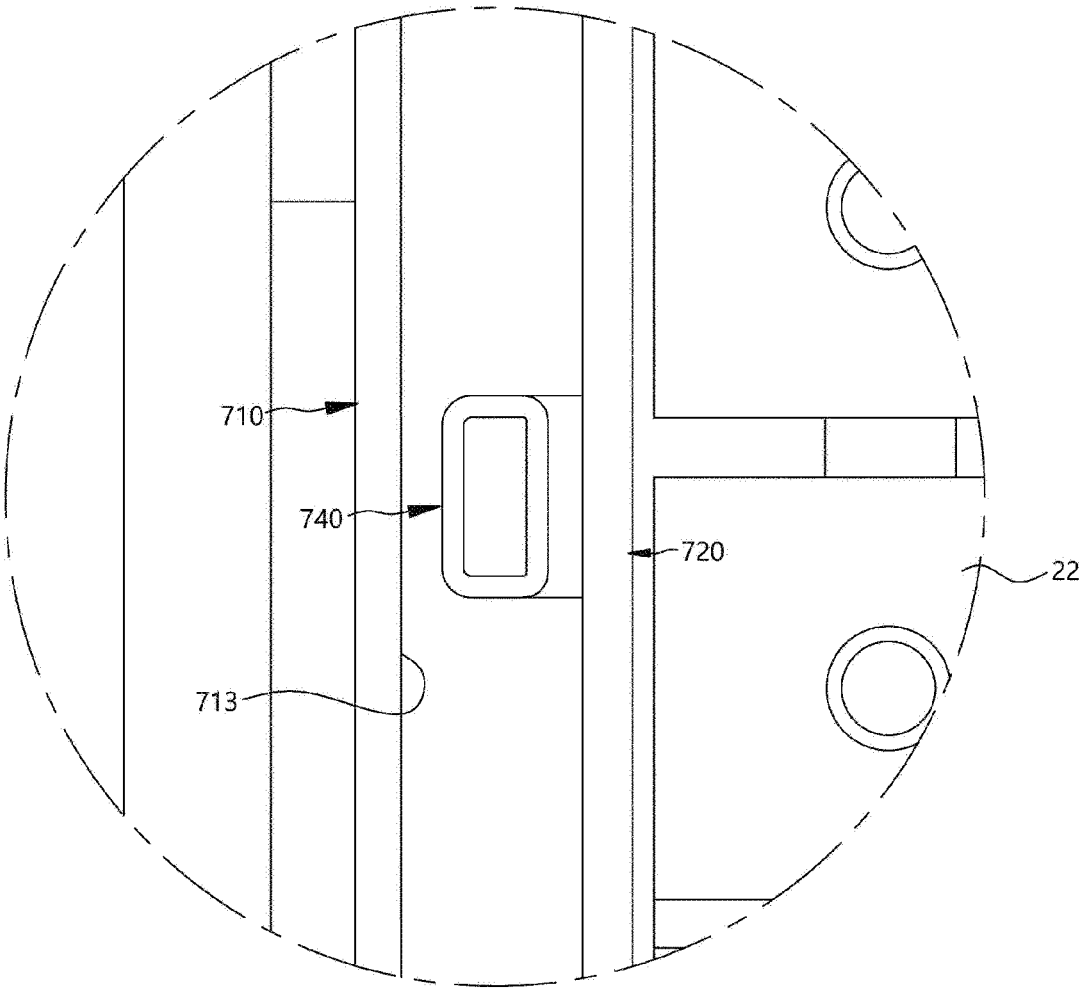

【Figure 18】
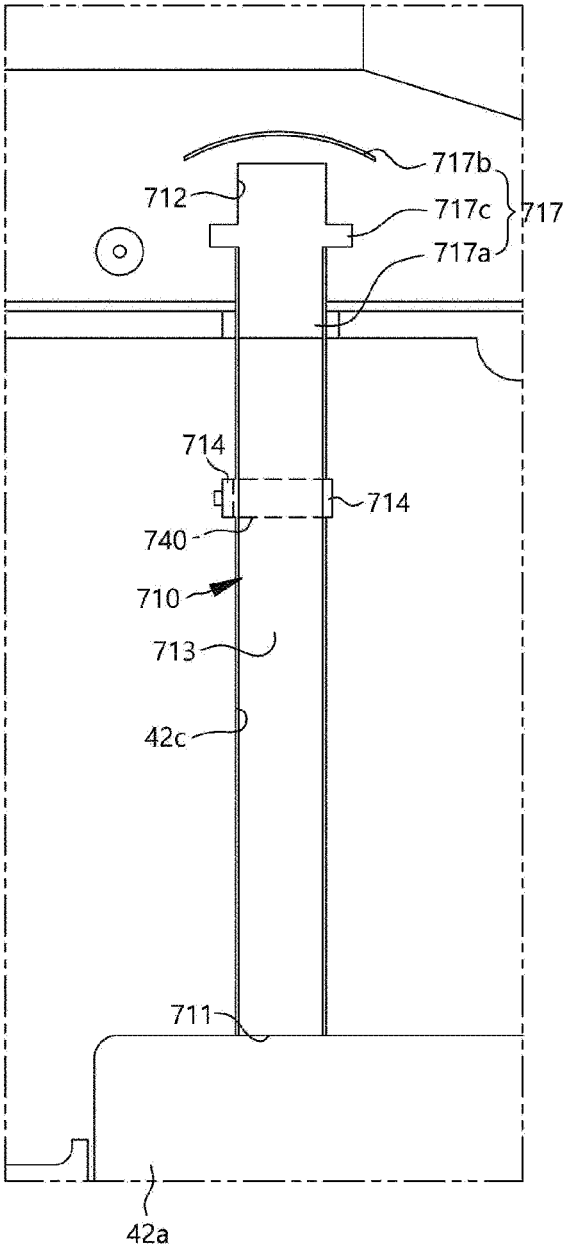

【Figure 19】
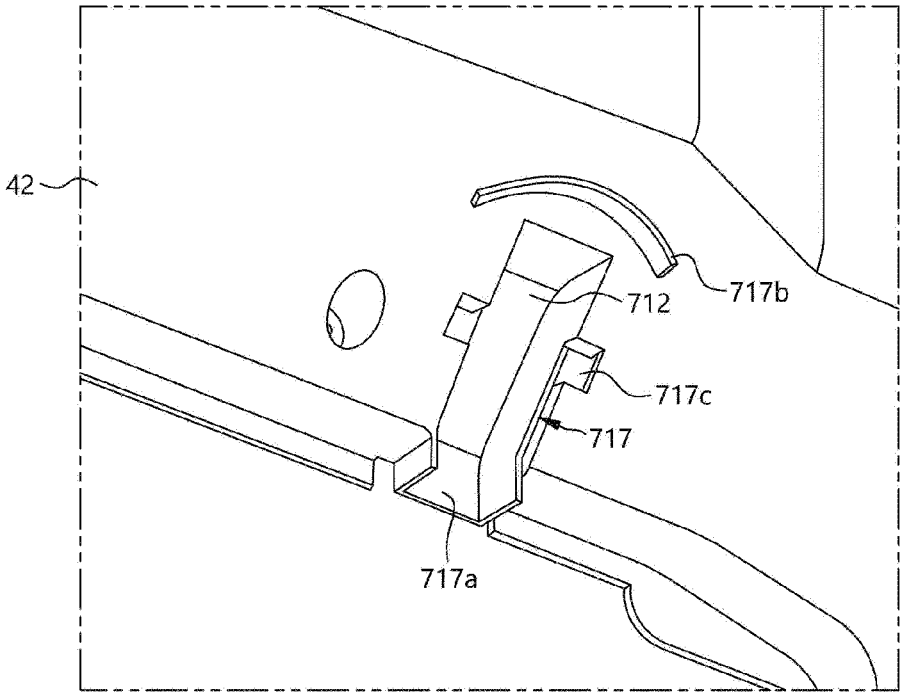

【Figure 20】
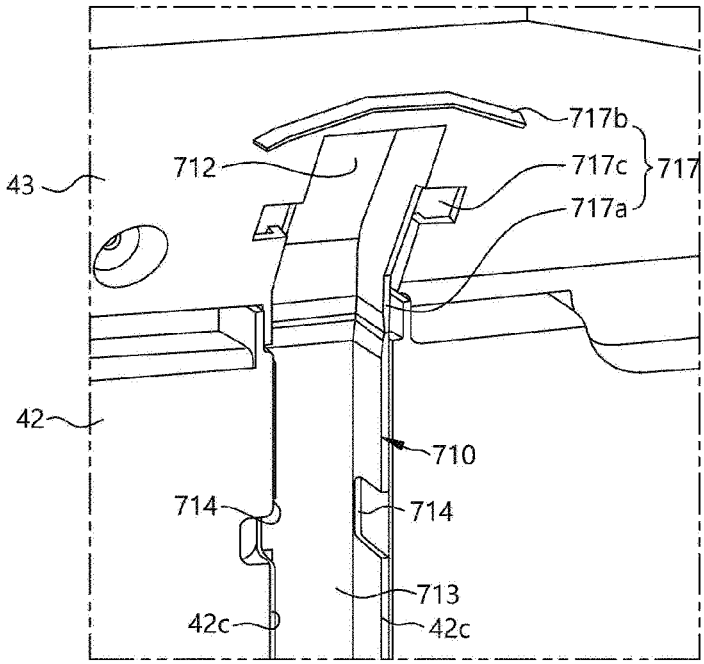

【Figure 21】
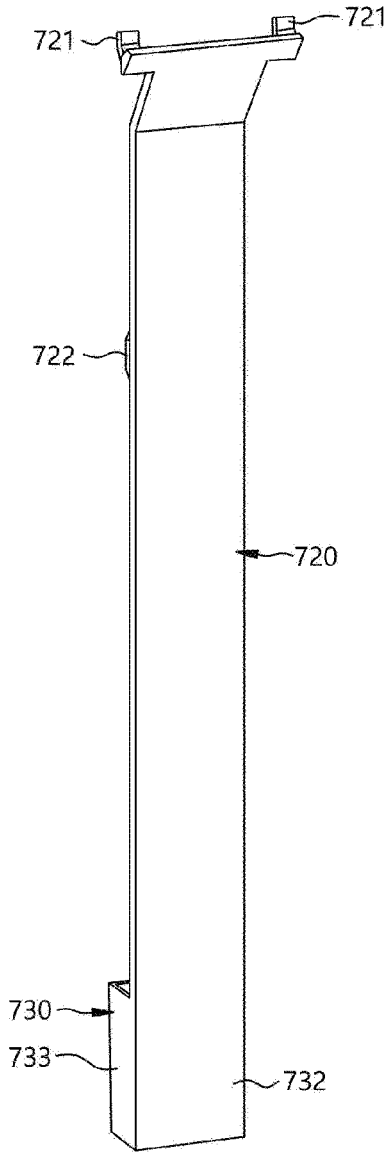

【Figure 22】
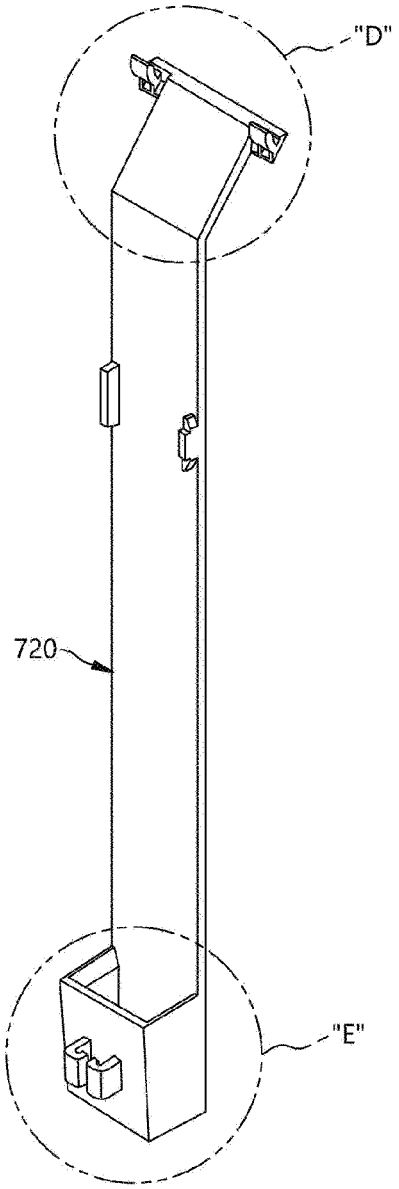

【Figure 23】
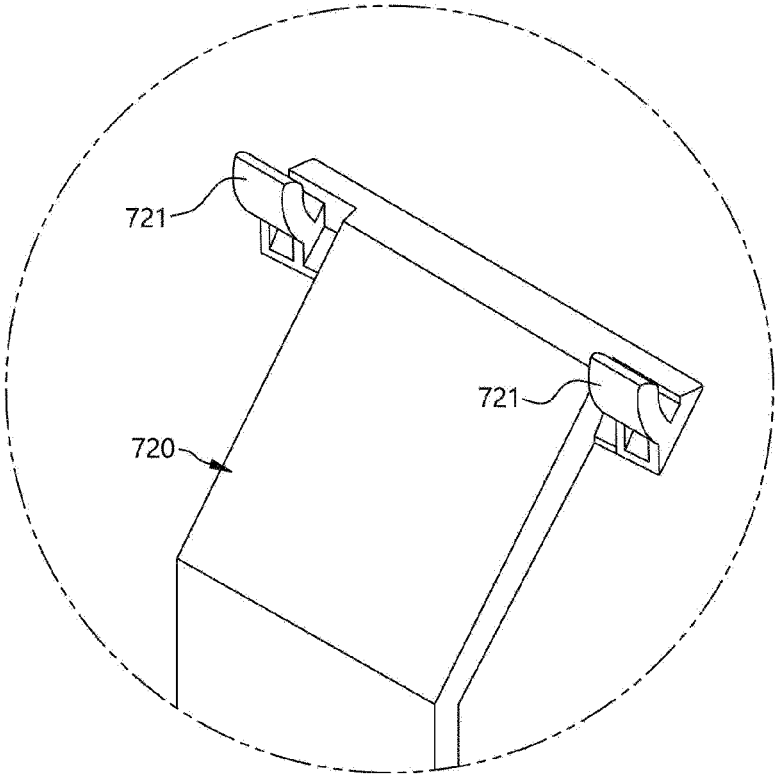

【Figure 24】
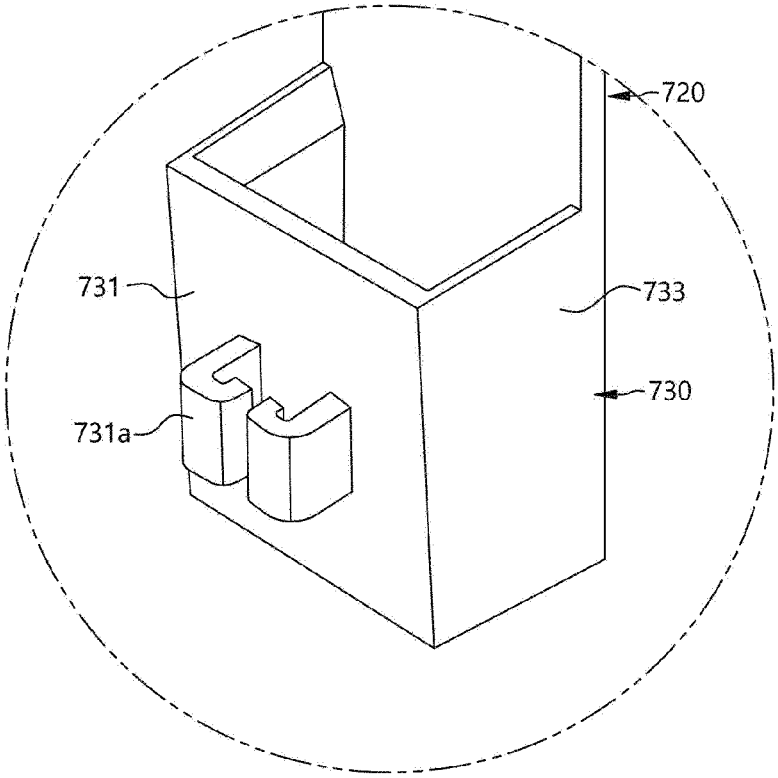

【Figure 25】
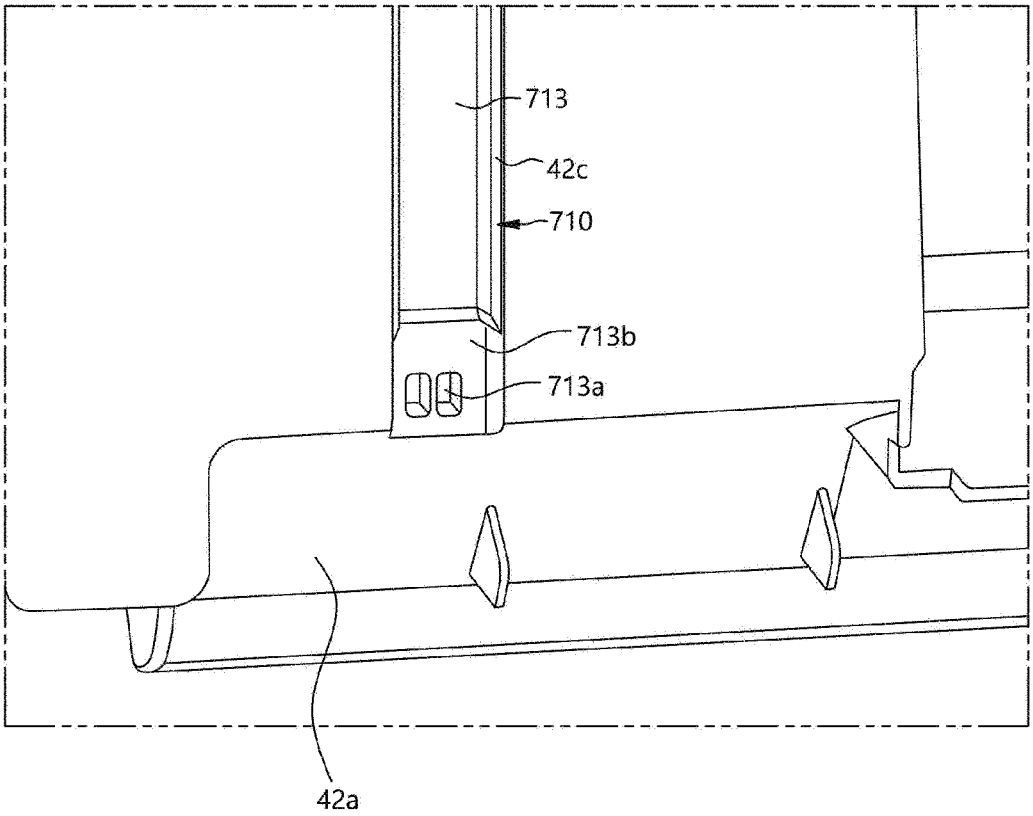

【Figure 26】
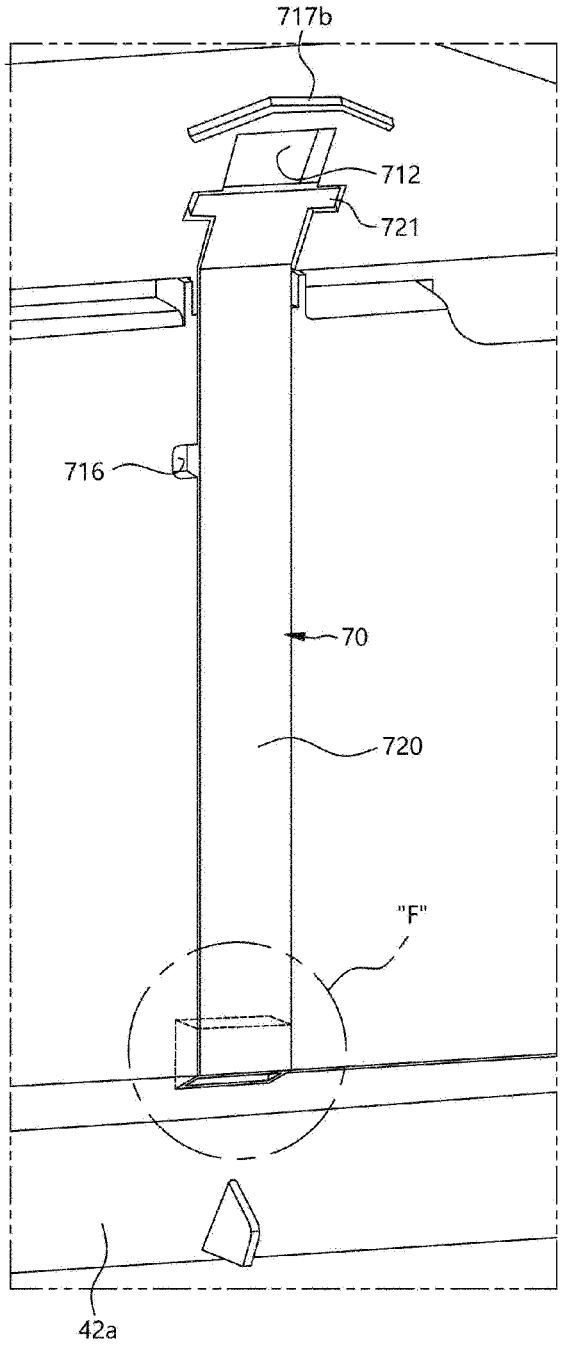

【Figure 27】
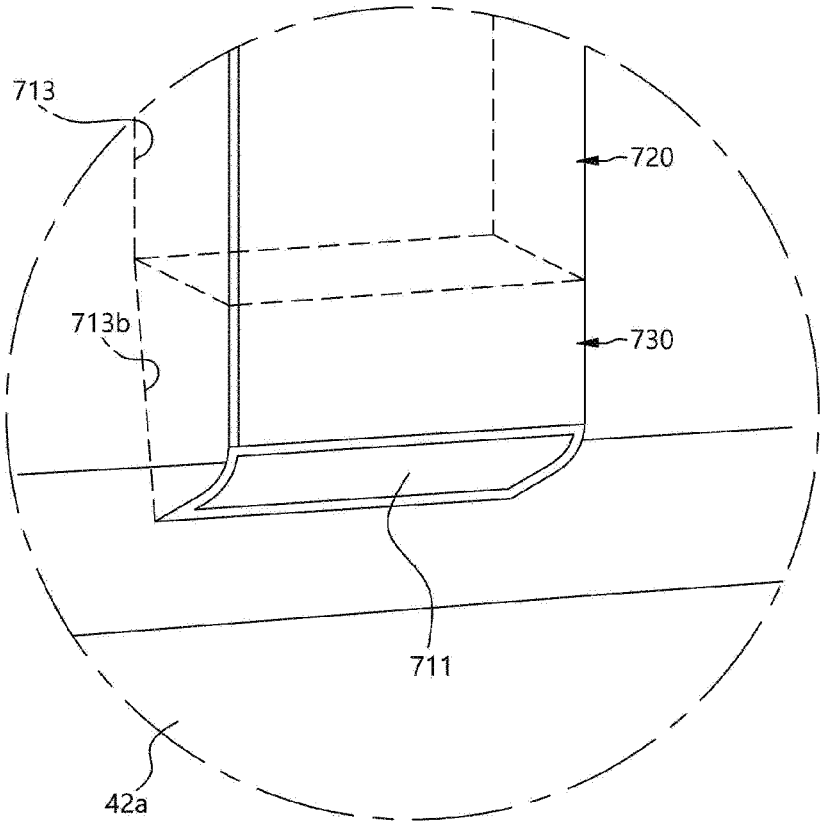

【Figure 28】
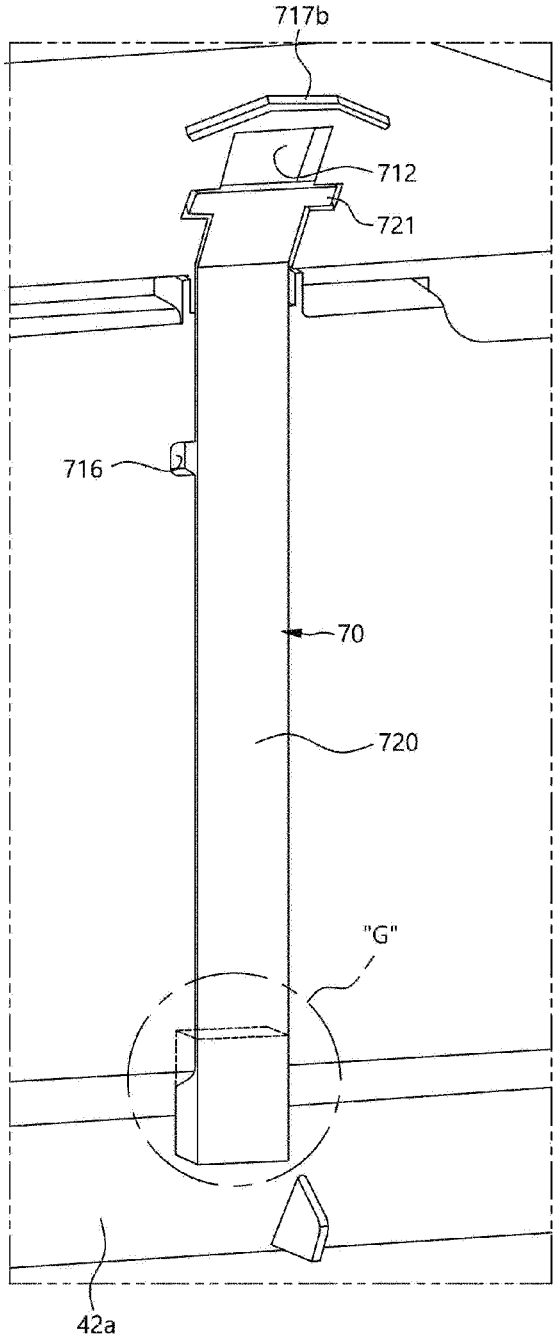

【Figure 29】
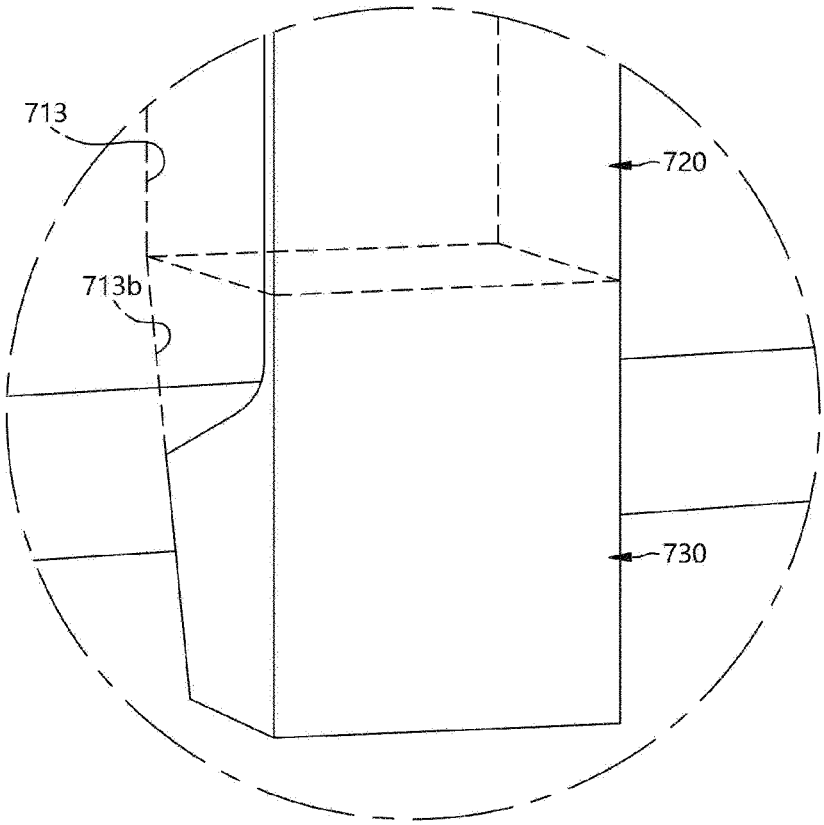

【Figure 30】
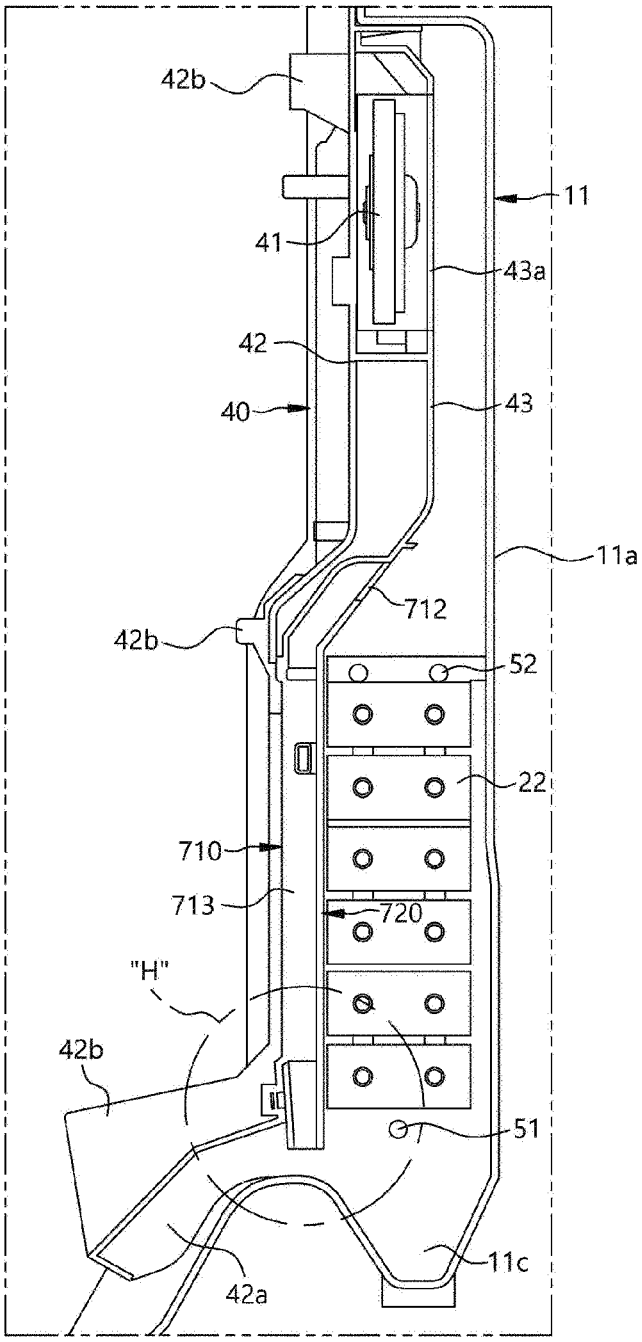

【Figure 31】
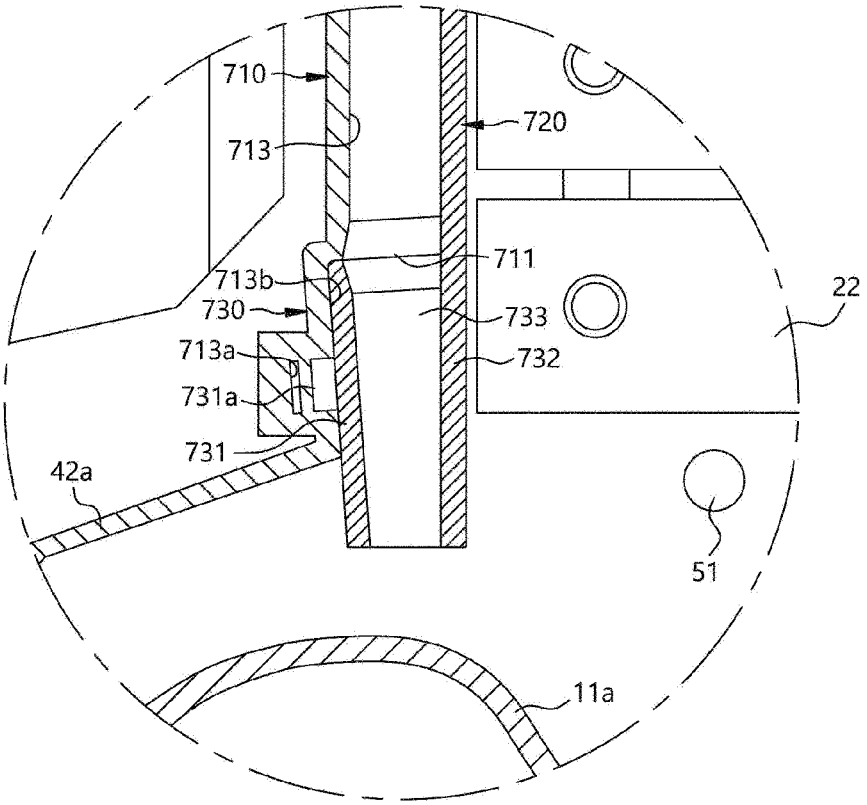

【Figure 32】
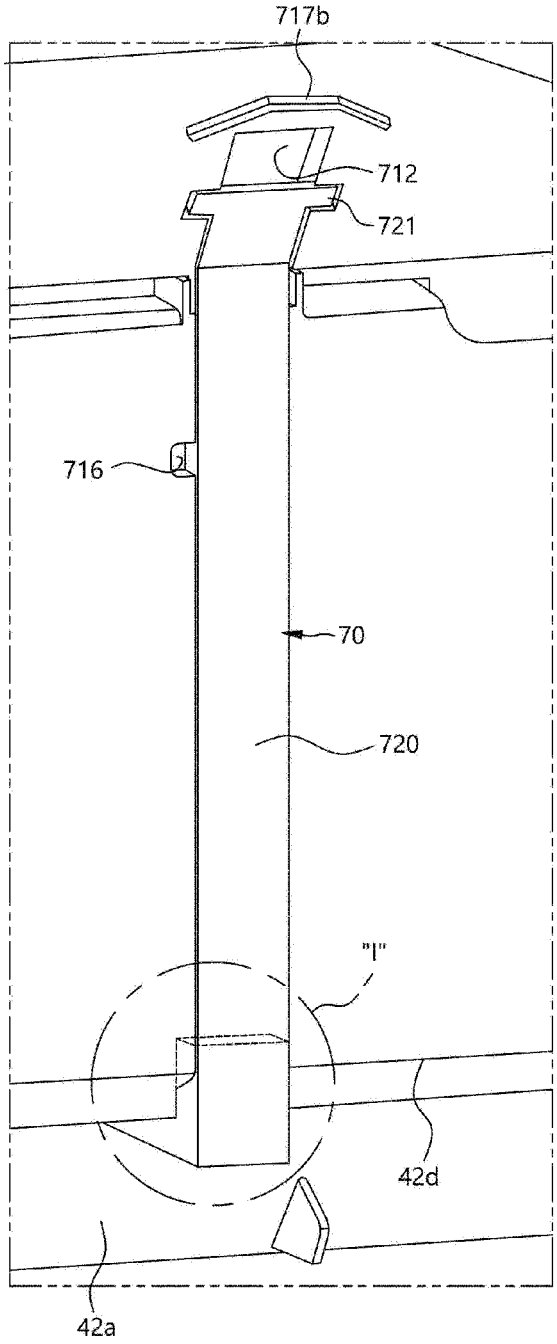

【Figure 33】
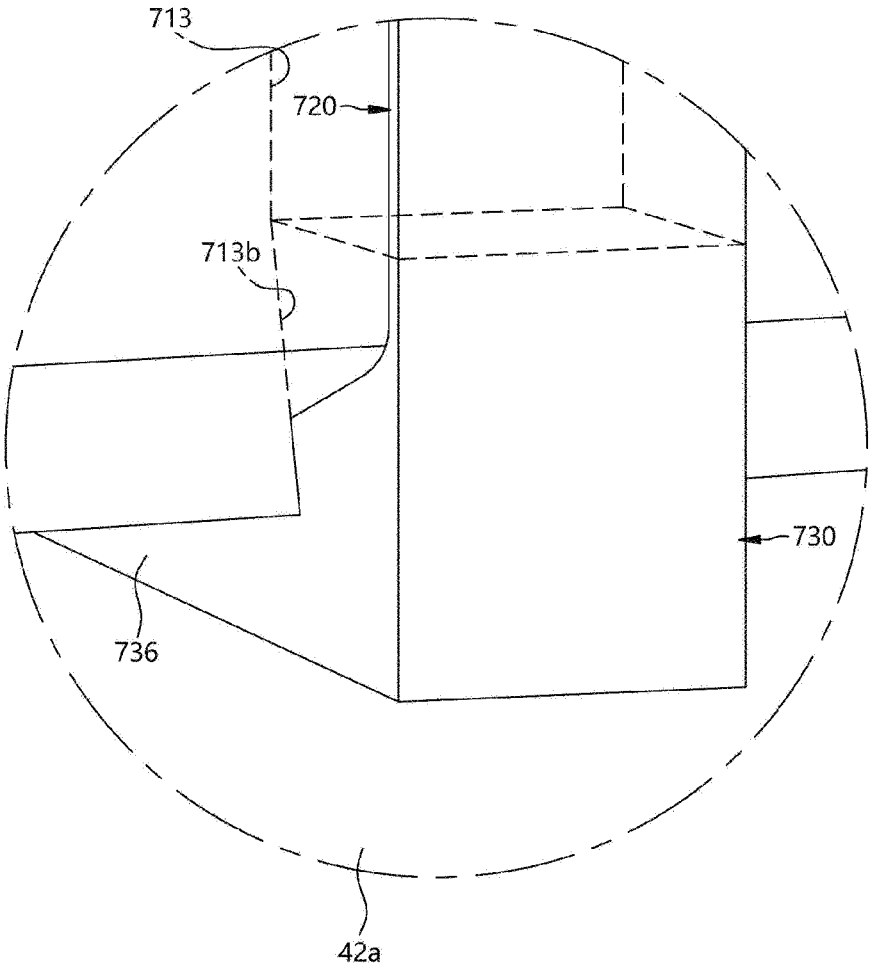

【Figure 34】
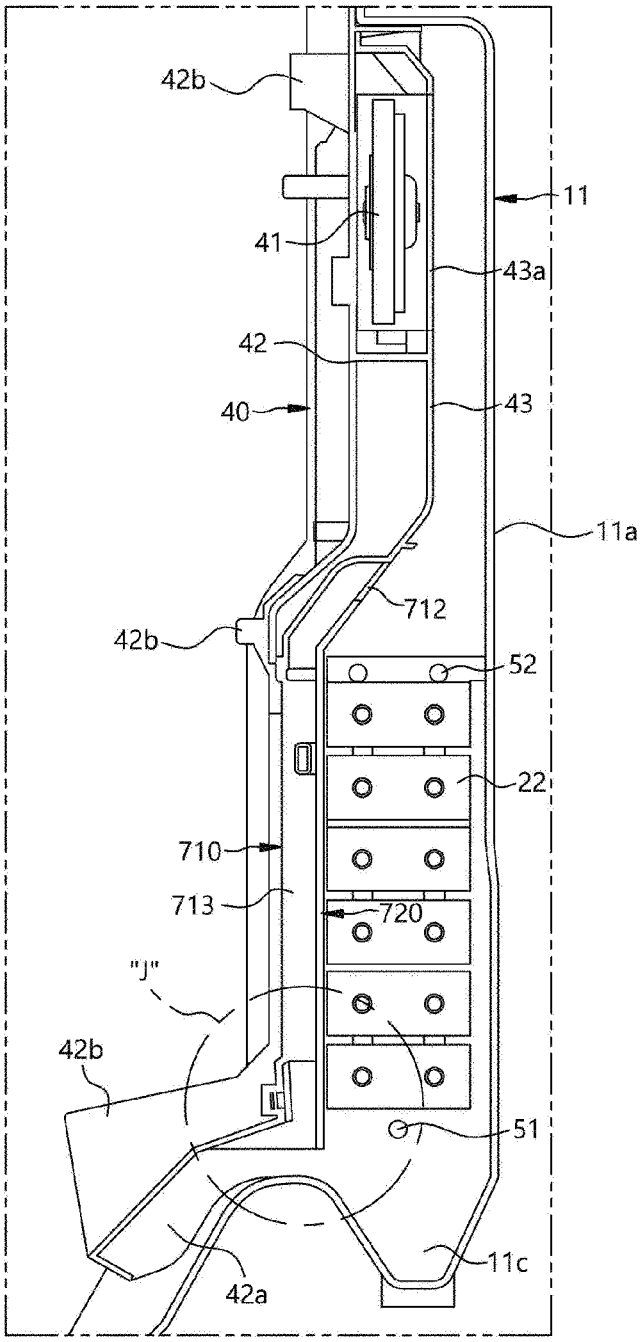

【Figure 35】
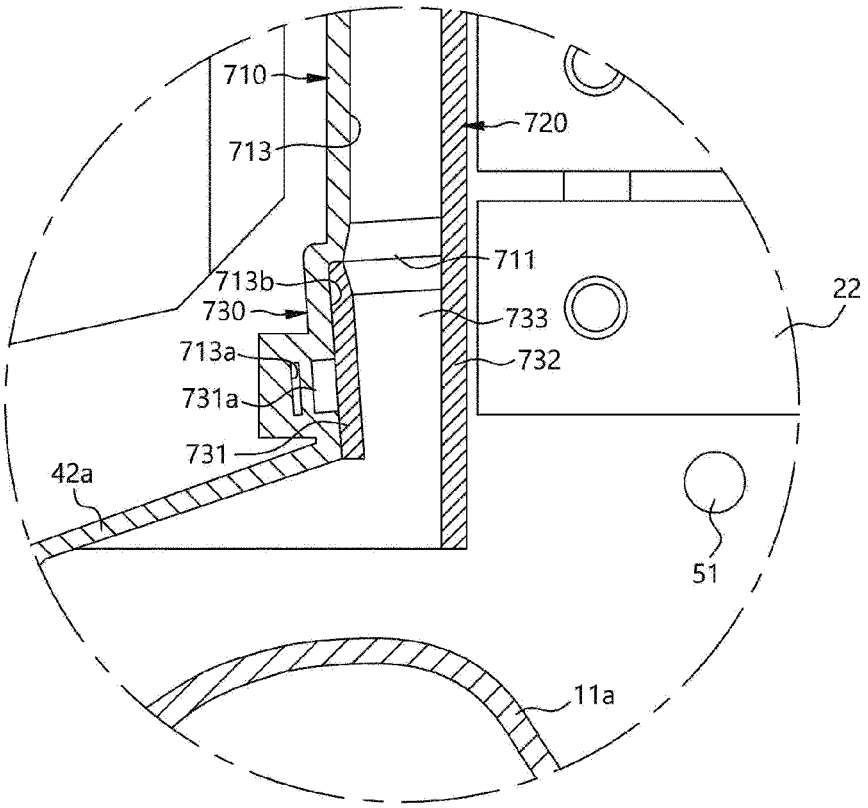
【Figure 36】
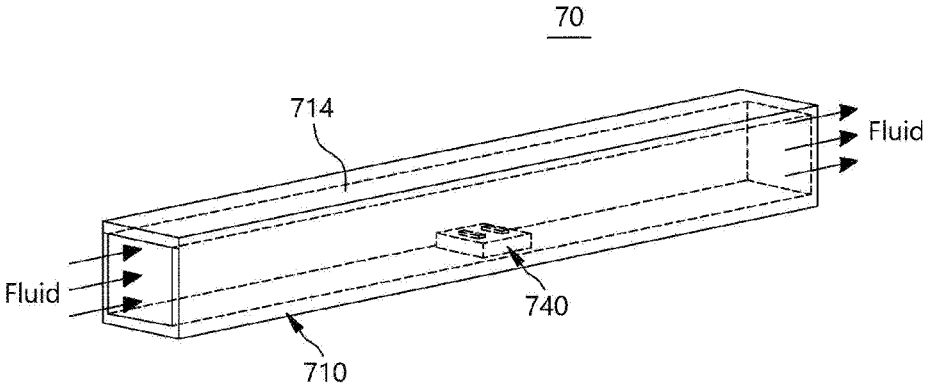

【Figure 37】
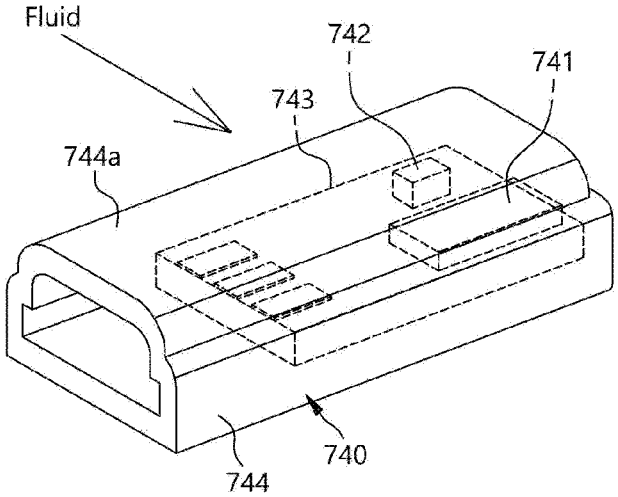

【Figure 38】
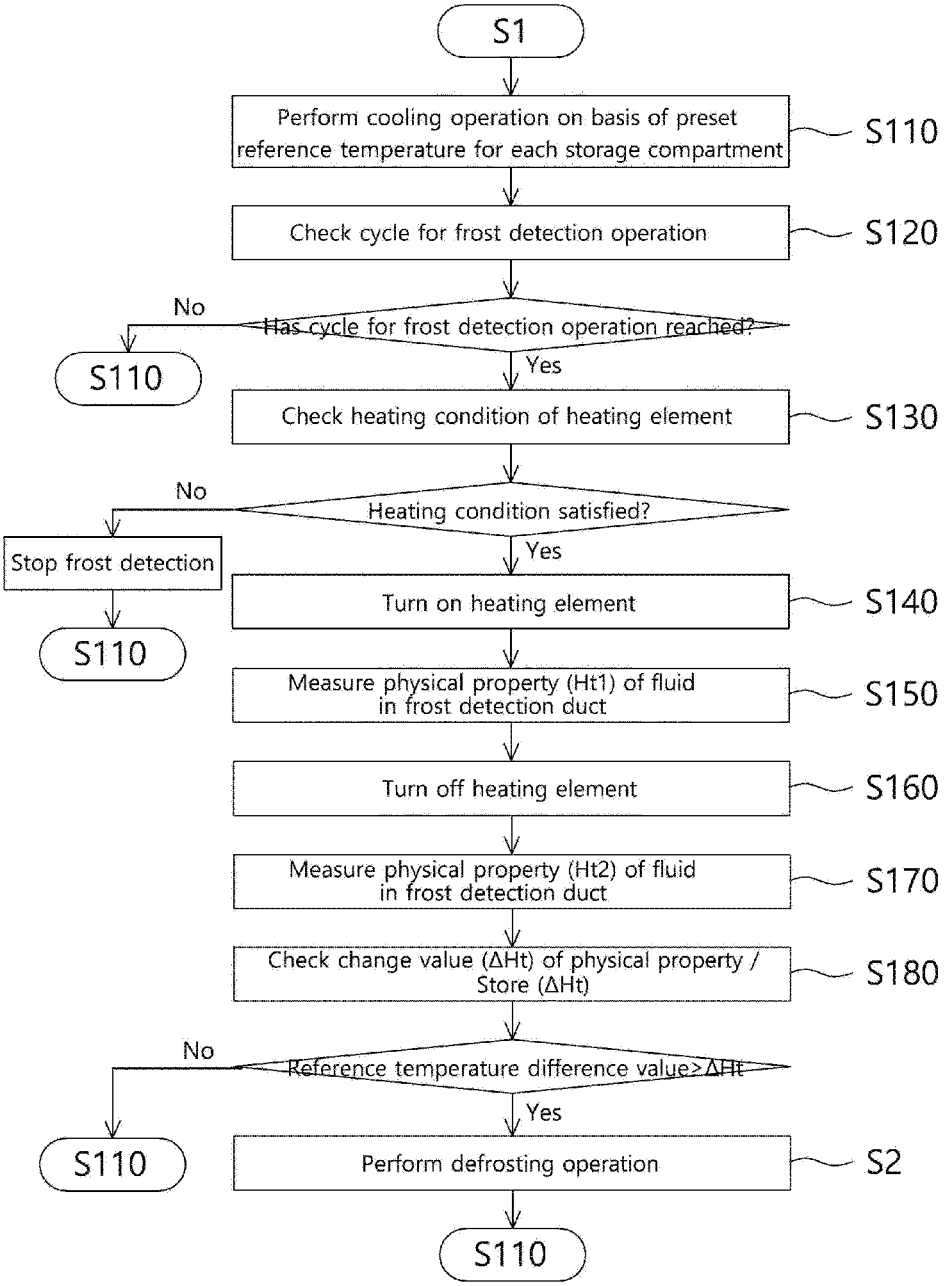

【Figure 39】
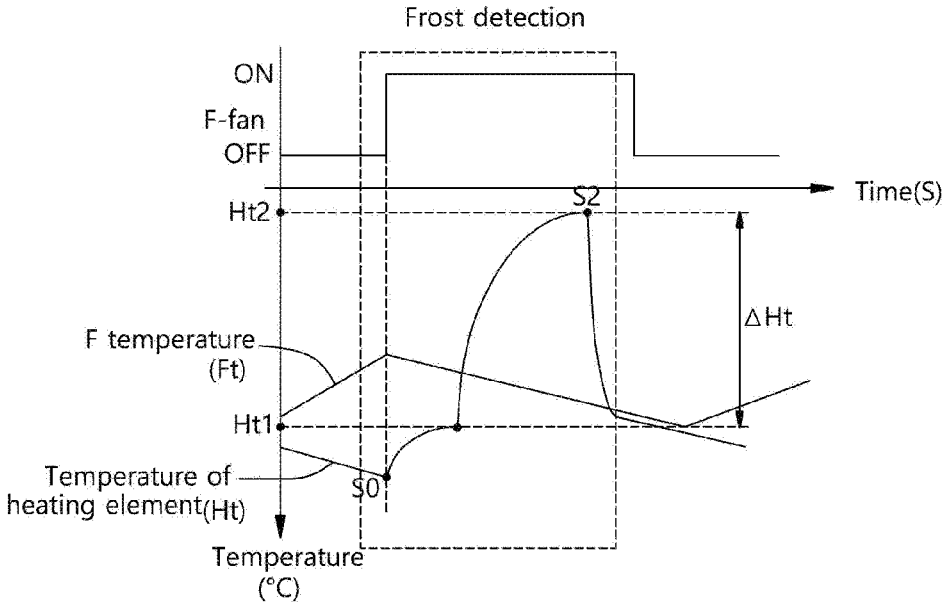

【Figure 40】
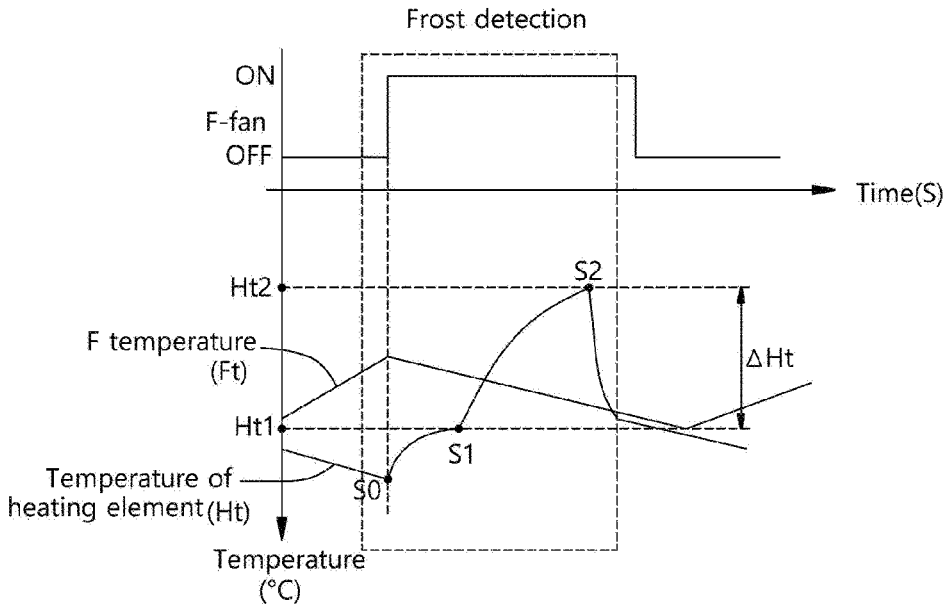

REFRIGERATOR

TECHNICAL FIELD

The present disclosure relates to a refrigerator in which the structure of a fluid introduction part of a frost detection duct is improved for detection accuracy of a frost detection device.

BACKGROUND

Generally, a refrigerator is an appliance that uses cold air to store items stored in storage space for a long time or while maintaining at a constant temperature.

The refrigerator is provided with a refrigeration system including one or more evaporators and is configured to generate and circulate the cold air.

Here, the evaporator serves to maintain air inside the refrigerator within a preset temperature range by exchanging heat between a low-temperature and low-pressure refrigerant and the air inside the refrigerator (cold air circulating inside the refrigerator).

While the evaporator is exchanging heat with the internal air of the refrigerator, frost may be formed on the evaporator due to water or moisture contained in the internal air, or moisture present around the evaporator.

In a conventional technology, a defrosting operation is performed to remove frost formed on the surface of the evaporator when a certain time has elapsed after the operation of the refrigerator has started.

That is, in the conventional technology, the defrosting operation is performed through indirect estimation based on the operation time of the refrigerator, rather than directly detecting the amount of frost formed on the surface of the evaporator.

Accordingly, in the conventional technology, even if frost is not formed, the defrosting operation may be performed, thereby decreasing power consumption efficiency, or even if frost is excessively formed, the defrosting operation may not be performed.

Particularly, the defrosting operation is performed by operating a heater to increase a temperature around the evaporator, and after the defrosting operation is performed, the refrigerator is operated with a large load to rapidly reach a preset temperature therein, thereby causing high power consumption.

Accordingly, various studies are being conducted to shorten a period of time of the defrosting operation or the cycle of the defrosting operation.

Recently, in order to accurately check the amount of frost formed on the surface of the evaporator, a method using temperature or pressure difference between the inlet side and outlet side of the evaporator has been proposed. This is disclosed in Korean Patent Application Publication Nos. 10-2019-0101669 (document 1), 10-2019-0106201 (document 2), 10-2019-0106242 (document 3), 10-2019-0112482 (document 4), and 10-2019-0112464 (document 5).

According to the above-described technologies, a guide flow path (a bypass flow path) configured to have the flow of air separate from the flow of air passing through an evaporator is formed in a cold air duct, and temperature difference changing according to difference of the amount of air passing through the guide flow path due to frost formed on the evaporator is measured to check the amount of the frost.

Accordingly, the amount of frost may be substantially checked, and based on this checked amount of the frost, start time of the defrosting operation may be accurately determined.

Meanwhile, to improve detection reliability for the amount of frost formed on the evaporator, it is preferable that the amount of air passing through a frost detection duct is significantly different before and after frost is formed on a cooling source.

The method of increasing difference in the amount of air may be variously performed.

In document 1, to increase the reliability of frost detection, the position of a sensor, a control method of a controller, a structure of protruding a fluid introduction part (a barrier) from the guide flow path (the bypass flow path), and positions of the inlet and outlet of the frost detection duct are proposed.

However, in the protruding structure of the fluid introduction part (the barrier) proposed in document 1 described above, the protruding length of the fluid introduction part and the length of a slot are simply presented only with numbers, so when a duct is changed for a different model of a refrigerator, it is difficult to obtain the same effect.

In addition, discrimination power to recognize various pieces of information related to frost may be obtained only when the difference of a temperature checked by a frost detection device during frost detection at least exceeds 30° C.

In this case, the various pieces of information related to frost may include detection of frost, the blockage of the frost detection duct, and whether residual ice is present after defrosting, etc.

Additionally, in the conventional technology, a slot is formed in a surface facing an evaporator which is the rear surface of the fluid introduction part.

This slot is a part provided such that air passing through the evaporator may flow back into the guide flow path when frost is present on the evaporator.

However, the frost detection device of the document described above is a design structure considering application to the fluid flow path of an existing refrigerator, and thus when the frost detection device is applied to the fluid flow path of a refrigerator with a structure different from the existing refrigerator (for example, when there is an interfering object in the associated fluid flow path), the frost detection device is unavoidably designed to have a new structure.

Furthermore, when measuring the freezing of the evaporator by using other physical properties instead of a method of measuring the freezing of the evaporator by using temperature difference between the turning on and off of the heating element, it may be advantageous when the flow rate of fluid flowing into the guide flow path is greater.

However, the document described above has a disadvantage in that a frost detection device in an optimal form which considers change in the condition of checking the physical properties when the change of the condition occurs is not provided. That is, even when the flow purpose of fluid introduced into the guide flow path changes, the document cannot cope with the change.

In addition, in the documents, the fluid introduction part (the barrier) formed in a flow path cover is installed to be received in the guide flow path (the bypass flow path).

However, when it is considered that the fluid introduction part which is open in upper and lower sides thereof is formed as a tubular body which is empty inside, the width of a flow path inside the fluid introduction part is unavoidably different from the width of a flow path in the guide flow path, and due to difference between this widths, moisture (e.g., defrost water) flowing down in the guide flow path may gather in a step portion therebetween, which may freeze in the inside of the fluid introduction part.

SUMMARY

The present disclosure has been made keeping in mind the above problems and is intended to enable the width of a flow path in a fluid introduction part and the width of a flow path in a guide flow path to be the same so that moisture flowing down in the guide flow path may efficiently be discharged without becoming stagnant so as to prevent freezing of an associated portion.

In addition, the present disclosure is intended to provide different types of frost detection devices according to the structure of a fluid flow path or the flow purpose of fluid.

In a refrigerator of the present disclosure, a frost detection device may include a frost detection duct which provides a flow path through which fluid passes.

In the refrigerator of the present disclosure, the frost detection device may include a flow path cover which covers the frost detection duct to separate the frost detection duct from a cooling source.

The refrigerator of the present disclosure may include a frost check sensor provided inside the frost detection duct.

In the refrigerator of the present disclosure, the flow path cover may include a fluid introduction part provided on a lower end thereof, the fluid introduction part having peripheral wall surfaces.

In the refrigerator of the present disclosure, at least a portion of the fluid introduction part may be received in the frost detection duct.

In the refrigerator of the present disclosure, the open lower surface of the fluid introduction part may be disposed to be exposed to an introduction flow path through which fluid flows through a first duct to the cooling source.

In the refrigerator of the present disclosure, a flow path exit in the fluid introduction part and a flow path entrance in the frost detection duct may be formed in the same size. Accordingly, water flowing down through the frost detection duct may not stay or gather at a portion in which the frost detection duct is coupled to the fluid introduction part, but may be directly discharged to the lower side of the fluid introduction part.

In the refrigerator of the present disclosure, at least a portion of a guide flow path may be disposed in a flow path formed between the first duct and the cooling source. Accordingly, fluid flowing to the cooling source by being introduced into the first duct may partially flow into the guide flow path.

In the refrigerator of the present disclosure, at least a portion of the guide flow path may be disposed in a flow path formed between a second duct and a storage compartment. Accordingly, fluid passing through the guide flow path may flow through the second duct to the storage compartment.

In the refrigerator of the present disclosure, the physical property of fluid measured by the frost detection device may include at least one of temperature, pressure, and flow rate.

In the refrigerator of the present disclosure, the frost check sensor may include a sensing element.

In the refrigerator of the present disclosure, the frost check sensor may include a sensing inductor.

In the refrigerator of the present disclosure, the sensing inductor may be configured as a means for inducing the improvement of precision when measuring physical properties.

In the refrigerator of the present disclosure, the sensing inductor constituting the frost detection device may include a heating element which generates heat.

In the refrigerator of the present disclosure, the sensing element constituting the frost detection device may include a sensor which measures the temperature of heat. Accordingly, the frost detection device may measure a temperature difference value $\Delta Ht$ (a logic temperature) according to a fluid flow rate.

In the refrigerator of the present disclosure, the cooling source may include at least one of a thermoelectric module or an evaporator.

In the refrigerator of the present disclosure, the thermoelectric module may include a thermoelectric element.

In the refrigerator of the present disclosure, the refrigerator may include a refrigerant valve.

In the refrigerator of the present disclosure, the refrigerator may include a compressor which compresses a refrigerant supplied to the evaporator.

In the refrigerator of the present disclosure, the refrigerator may include a cooling fan which operates to circulate fluid around the evaporator to the storage compartment.

In the refrigerator of the present disclosure, the flow path of the inside of the frost detection duct may be formed vertically. Accordingly, flow resistance in the flow path may be reduced.

In the refrigerator of the present disclosure, the internal flow path of the fluid introduction part may be formed to be inclined to have an inner width decreasing gradually downward from the internal flow path of the frost detection duct. Accordingly, fluid flowing down in the frost detection duct may be prevented from gathering and freezing in a coupling portion of the frost detection duct to the fluid introduction part.

Particularly, a front wall surface of the fluid introduction part may be formed to incline rearward gradually toward a lower side, and thus fluid flowing down in the fluid introduction part may flow toward a condensate collector located under a second evaporator by passing the highest position of the bottom surface of the rear side of an inner casing.

In the refrigerator of the present disclosure, a seating recess may be formed in the lower end of the inside of the frost detection duct by being recessed therefrom.

In the refrigerator of the present disclosure, the fluid introduction part may be seated and installed on the internal lower end of the frost detection duct. Accordingly, the fluid introduction part may be placed at an accurate position.

In the refrigerator of the present disclosure, the depth of the seating recess may be equal to the thickness of each of the peripheral wall surfaces of the fluid introduction part. Accordingly, the internal flow path of the fluid introduction part and the internal flow path of the frost detection duct may match each other.

In the refrigerator of the present disclosure, the first duct may be formed to incline downward gradually forward by protruding toward the inside of the storage compartment from the lower end of the second duct.

In the refrigerator of the present disclosure, the lower surface of the fluid introduction part may be configured to be located on the same surface as the bottom surface of the first duct.

In the refrigerator of the present disclosure, the lower end of the fluid introduction part may be formed by protruding downward from the bottom surface of the first duct. Accordingly, the lower surface of the fluid introduction part may be located lower than the bottom surface of the first duct, which provides resistance to the flow of fluid passing through the lower part of the first duct.

A close contact end may be formed on the lower end of the fluid introduction part constituting the refrigerator of the present disclosure by protruding forward therefrom such that the upper surface of the close contact end has the same inclination as the inclination of the first duct. Accordingly, the close contact end may be in close contact with the bottom surface of the first duct.

In addition, in the refrigerator of the present disclosure, the lower surface of the fluid introduction part may be formed to have the same inclination as the inclination of the first duct.

Furthermore in the refrigerator of the present disclosure, the lower surface of the fluid introduction part may be formed to have the same height at each of front and rear of the lower surface.

As described above, according to the refrigerator of the present disclosure, the width of the internal flow path of the fluid introduction part and the width of the internal flow path of the guide flow path may be the same, and thus water flowing down in the guide flow path may efficiently be discharged without becoming stagnant or gathering between the guide flow path and the flow path inside the fluid introduction part, thereby preventing freezing in an associated portion.

In addition, according to the refrigerator of the present disclosure, the front wall of the fluid introduction part may be formed to incline rearward gradually toward a lower side, and thus defrost water flowing down into the fluid introduction part through the guide flow path may more efficiently flow downward without becoming stagnant in an associated portion.

Particularly, the inclination may be directed to a portion at which the condensate collector is formed past the highest position of the bottom surface of the rear of the inner casing, and thus defrost water flowing down through the fluid introduction part may flow down toward the condensate collector. Accordingly, the defrost water may be prevented from flowing down into the storage compartment.

Additionally, according to the refrigerator of the present disclosure, any one of a plurality of flow path covers having fluid introduction parts formed in different structures may be selectively provided, thereby providing an optimal fluid introduction part according to the structure or purpose of a fluid flow path.

DESCRIPTION OF DRAWINGS

FIG. 1 is a front view schematically illustrating an internal configuration of a refrigerator according to an embodiment of the present disclosure.

FIG. 2 is a vertical sectional view schematically illustrating the configuration of the refrigerator according to the embodiment of the present disclosure.

FIG. 3 is a state view schematically illustrating the state of operation performed according to an operation reference value relative to a reference temperature set by a user for each storage compartment of the refrigerator according to the embodiment of the present disclosure.

FIG. 4 is a block diagram schematically illustrating a control structure of the refrigerator according to the embodiment of the present disclosure.

FIG. 5 is a view schematically illustrating the structure of a thermoelectric module according to the embodiment of the present disclosure.

FIG. 6 is a block diagram schematically illustrating a refrigeration cycle of the refrigerator according to the embodiment of the present disclosure.

FIG. 7 is a sectional view illustrating a rear space of a second storage compartment in a casing for illustrating the installation state of a frost detection device and an evaporator constituting the refrigerator according to the embodiment of the present disclosure.

FIG. 8 is an enlarged view of an "A" part of FIG. 7.

FIG. 9 is a front exploded perspective view of a fan duct assembly illustrating the installation state of the frost detection device constituting the refrigerator according to the embodiment of the present disclosure.

FIG. 10 is a rear exploded perspective view of illustrating the installation state of the frost detection device constituting the refrigerator according to the embodiment of the present disclosure.

FIG. 11 is a rear perspective view of the fan duct assembly illustrating the installation state of the frost detection device constituting the refrigerator according to the embodiment of the present disclosure.

FIG. 12 is an exploded perspective view illustrating a state in which a flow path cover and a sensor are separated from the fan duct assembly of the refrigerator according to the embodiment of the present disclosure.

FIG. 13 is an enlarged view of "B" part of FIG. 12.

FIG. 14 is a rear view of illustrating the fan duct assembly for illustrating a relation between the installation positions of the frost detection device and a cooling source constituting the refrigerator according to the embodiment of the present disclosure.

FIG. 15 is a rear view illustrating the fan duct assembly seen from a rear thereof to illustrate the installation state of the frost detection device constituting the refrigerator according to the embodiment of the present disclosure.

FIG. 16 is a front view illustrating the state of the front surface of a shroud constituting the fan duct assembly of the refrigerator according to the embodiment of the present disclosure.

FIG. 17 is an enlarged view of a "C" part of FIG. 7.

FIG. 18 is a view illustrating the internal structure of a frost detection duct constituting the frost detection device of the refrigerator according to the embodiment of the present disclosure.

FIG. 19 is a perspective view illustrating the structures of a guide flow path and a fluid exit part of the frost detection duct constituting the frost detection device of the refrigerator according to the embodiment of the present disclosure.

FIG. 20 is a perspective view illustrating the relation of the coupling of the guide flow path to the fluid exit part constituting the frost detection duct of the refrigerator according to the embodiment of the present disclosure.

FIG. 21 is a perspective view illustrating the flow path cover constituting the frost detection duct of the refrigerator according to the embodiment of the present disclosure.

FIG. 22 is the rear perspective view illustrating the flow path cover constituting the frost detection duct of the refrigerator according to the embodiment of the present disclosure.

FIG. 23 is an enlarged view of a "D" part of FIG. 22.

FIG. 24 is an enlarged view of an "E" part of FIG. 22.

FIG. 25 is a view illustrating a portion to which a second coupling part of the flow path cover is coupled according to the embodiment of the present disclosure.

FIG. 26 is a perspective view illustrating an example of the installation state of the frost detection device according to the embodiment of the present disclosure.

FIG. 27 is an enlarged view of an "F" part of FIG. 26.

FIG. 28 is a perspective view illustrating another example of the installation state of the frost detection device according to the embodiment of the present disclosure.

FIG. 29 is an enlarged view of a "G" part of FIG. 28.

FIG. 30 is a sectional view illustrating the another example of the installation state of the frost detection device according to the embodiment of the present disclosure.

FIG. 31 is an enlarged view of an "H" part of FIG. 30.

FIG. 32 is a perspective view illustrating still another example of the installation state of the frost detection device according to the embodiment of the present disclosure.

FIG. 33 is an enlarged view of an "I" part of FIG. 32.

FIG. 34 is a sectional view illustrating the still another example of the installation state of the frost detection device according to the embodiment of the present disclosure.

FIG. 35 is an enlarged view of a "J" part of FIG. 34.

FIG. 36 is a view schematically illustrating a state in which a frost check sensor is installed in the frost detection duct constituting the frost detection device of the refrigerator according to the embodiment of the present disclosure.

FIG. 37 is a perspective view illustrating a structure in which the frost check sensor is installed in the frost detection duct of the refrigerator according to the embodiment of the present disclosure.

FIG. 38 is a flowchart illustrating a control process by a controller during the frost detection operation of the refrigerator according to the embodiment of the present disclosure.

FIGS. 39 and 40 are views illustrating a temperature change in the frost detection duct according to the on/off of the heating element and the on/off of each cooling fan while frost is formed in the evaporator of the refrigerator according to the embodiment of the present disclosure.

DETAILED DESCRIPTION

According to the present disclosure, a frost detection device may be applied differently for each of different types of refrigerators, and moisture flowing down in a frost detection duct does not stay or gather at a portion in which the frost detection duct is coupled to a fluid introduction part, but may be directly discharged to the lower side of the fluid introduction part.

The exemplary embodiments of the structure and operation control of the refrigerator of the present disclosure will be described with reference to FIGS. 1 to 40.

FIG. 1 is a front view schematically illustrating an internal configuration of the refrigerator according to the embodiment of the present disclosure, and FIG. 2 is a vertical sectional view schematically illustrating the configuration of the refrigerator according to the embodiment of the present disclosure.

The refrigerator 1 according to the embodiment of the present disclosure may include a casing 11.

The casing 11 may include an outer casing 11*b* constituting the exterior of the refrigerator 1.

In addition, the casing 11 may include an inner casing 11*a* constituting the inner wall surface of the refrigerator 1. The inner casing 11*a* may be formed to have a box-shaped structure with an open front surface so as to provide a storage compartment in which items are stored.

The storage compartment may include one storage compartment or multiple compartments.

In the embodiment of the present disclosure, for example, the storage compartment may include two storage compartments in which items are stored in temperatures different from each other.

The storage compartment may include a first storage compartment 12 maintained at a first set reference temperature.

The first set reference temperature may be a temperature at which stored items do not freeze, and may be in the range of a temperature lower than a temperature (a room temperature) outside the refrigerator 1.

For example, the first set reference temperature may be set in a temperature range of 32° C. or less and above 0° C. Of course, the first set reference temperature may be set to be higher than 32° C., or 0° C. or less when needed (for example, according to a room temperature or the type of a stored item).

Particularly, the first set reference temperature may be the internal temperature of the first storage compartment 12 set by a user.

When the user does not set the first set reference temperature, an arbitrarily designated temperature may be used as the first set reference temperature.

The first storage compartment 12 may be configured to operate with a first operation reference value to maintain the first set reference temperature.

The first operation reference value may be set as a temperature range value including a first lower limit temperature NT−DIFF1. For example, when the internal temperature of the first storage compartment 12 reaches the first lower limit temperature NT−DIFF1 relative to the first set reference temperature, operation for supplying cold air stops.

The first operation reference value may be set as a temperature range value including a first upper limit temperature NT+DIFF1. For example, when the internal temperature rises relative to the first set reference temperature, the operation for supplying cold air may restart before the internal temperature reaches the first upper limit temperature NT+DIFF1.

Accordingly, the supplying of cold air into the first storage compartment 12 may be performed or stopped in consideration of the first operation reference value for the first storage compartment based on the first set reference temperature.

The set reference temperature NT and the operation reference value DIFF are illustrated in FIG. 3.

In addition, the storage compartment may include a second storage compartment 13 maintained at a second set reference temperature.

The second set reference temperature may be lower than the first set reference temperature. In this case, the second set reference temperature may be set by a user, and when the user does not set the second set reference temperature, an arbitrarily designated temperature may be used as the second set reference temperature.

The second set reference temperature may be a temperature in which a stored item can freeze. For example, the second set reference temperature may be set in a temperature range of 0° C. or less and −24° C. or more. Of course, the second set reference temperature may be set to be higher than 0° C. or −24° C. or less when needed (for example, according to the room temperature or the type of a stored item).

The second set reference temperature may be the internal temperature of the second storage compartment 13 set by a user, and when the user does not set the second set reference temperature, an arbitrarily designated temperature may be used as the second set reference temperature.

The second storage compartment 13 may be configured to operate with a second operation reference value to maintain the second set reference temperature.

The second operation reference value may include a second lower limit temperature NT−DIFF2 and a second upper limit temperature NT+DIFF2.

The second operation reference value may be set as a temperature range value including the second upper limit temperature NT+DIFF2. For example, when the internal temperature of the second storage compartment 13 rises relative to the second set reference temperature, operation for supplying cold air may restart before the internal temperature reaches the second upper limit temperature NT+DIFF2.

Accordingly, in consideration of the second operation reference value for the second storage compartment based on the second set reference temperature, the supplying of cold air into the second storage compartment 13 may be performed or stopped.

The first operation reference value may be set to have a smaller range between the upper limit temperature and lower limit temperature than a range between the upper limit temperature and lower limit temperature of the second operation reference value. For example, the second upper limit temperature NT+DIFF2 and second lower limit temperature NT−DIFF2 of the second operation reference value may be set as ±2.0° C., and the first upper limit temperature NT+DIFF1 and first lower limit temperature NT−DIFF1 of the first operation reference value may be set as ±1.5° C.

Meanwhile, the storage compartments described above may be configured such that fluid circulates in each of the storage compartments so that the internal temperature thereof is maintained.

The fluid may be air. In description below, as an example, fluid that circulates through the storage compartment is air. Of course, the fluid may be a gas other than air.

A temperature (a room temperature) outside the storage compartment may be measured by a first temperature sensor 1*a* as illustrated in FIG. 4, and the internal temperature may be measured by a second temperature sensor 1*b*.

The first temperature sensor 1*a* and the second temperature sensor 1*b* may be configured separately. Of course, the room temperature and the internal temperature may be measured by the same one temperature sensor, or by at least two temperature sensors in cooperation with each other.

The second temperature sensor 1*b* may be provided in a second duct (e.g., a second fan duct assembly) to be described later, and this is illustrated in FIG. 10.

In addition, as illustrated in FIGS. 1 and 2, the storage compartment 12 or 13 may include the door 12*b* or 13*b*.

The door 12*b* or 13*b* may function to open and close the storage compartment 12 or 13, and may be configured as a swinging opening/closing structure or a drawer-type opening/closing structure.

The door 12*b* or 13*b* may include one door or at least two doors.

Next, the refrigerator 1 according to the embodiment of the present disclosure may include a cold air source.

The cold air source may include a structure which generates cold air (cooling source).

The cold air generation structure of the cold air source may be variously formed.

For example, the cooling source may include a thermoelectric module 23. That is, cool air may be generated by using the endothermic reaction of the thermoelectric module 23.

As illustrated in FIG. 5, the thermoelectric module 23 may include a thermoelectric element 23*a* including a heat absorbing surface 231 and a heat discharging surface 232. The thermoelectric module 23 may be configured as a module including a sink 23*b* connected to at least one of the heat absorbing surface 231 and the heat discharging surface 232 of the thermoelectric element 23*a*.

In the embodiment of the present disclosure, the cold air generation structure of the cold air source may be configured as a refrigeration system including an evaporator 21 or 22 (cooling source) and a compressor 60.

The evaporator 21 or 22 may constitute a refrigeration system together with the compressor 60 (see FIG. 6) and may function to exchange heat with air passing through the associated evaporator so as to lower the temperature of the fluid.

When the storage compartment includes the first storage compartment 12 and the second storage compartment 13, the evaporator may include the first evaporator 21 for supplying cold air to the first storage compartment 12, and a second evaporator 22 for supplying cold air to the second storage compartment 13.

In this case, inside the inner casing 11*a*, the first evaporator 21 may be located at a rear side of the inside of the first storage compartment 12, and the second evaporator 22 may be located at a rear side of the inside of the second storage compartment 13.

Of course, although not shown, one evaporator may be provided in only one storage compartment of the first storage compartment 12 and the second storage compartment 13.

Even if the refrigerator includes two evaporators, the compressor 60 constituting an associated refrigeration cycle may be only one compressor. In this case, as illustrated in FIG. 6, the compressor 60 may be connected to the first evaporator 21 to supply a refrigerant through a first refrigerant passage 61 to the first evaporator 21, and may be connected to the second evaporator 22 to supply a refrigerant through a second refrigerant passage 62 to the second evaporator 22. In this case, each of the refrigerant passages 61 and 62 may be selectively opened/closed by a refrigerant valve 63.

The cold air source may include a structure for supplying the generated cold air to the storage compartment.

The cold air supply structure of the cold air source may include may include a cooling fan. The cooling fan may be configured to perform the function of supplying cold air generated by passing through the cooling source to the storage compartments 12 and 13.

The cooling fan may include a first cooling fan 31 which supplies cold air generated by passing through the first evaporator 21 to the first storage compartment 12.

The cooling fan may include a second cooling fan 41 which supplies cold air generated by passing through the second evaporator 22 to the second storage compartment 13.

Next, the refrigerator 1 according to the embodiment of the present disclosure may include a first duct.

The first duct may be formed as at least one of a passage (e.g., a tube such as a duct or a pipe), a hole, and an air flow path through which air passes. Air may flow from the inside of the storage compartment to the cooling source under the guidance of the first duct.

With reference to FIG. 7, the first duct may include an introduction duct 42*a*. That is, fluid flowing through the second storage compartment 13 may flow into the second evaporator 22 by the guidance of the introduction duct 42*a*.

In addition, the first duct may include a portion of the bottom surface of the inner casing 11*a*. In this case, the portion of the bottom surface of the inner casing 11*a* may be a portion may be a portion ranging from a portion facing the bottom surface of the introduction duct 42*a* to a position in which the second evaporator 22 is mounted.

More specifically, the first duct may include a portion connected to the condensate collector 11*c* through the highest position of an associated inclination from a portion formed to incline upward in the rear bottom surface of the inner casing 11*a*.

Accordingly, the first duct may provide a flow path (hereinafter, referred to as "an introduction flow path") through which fluid flows between the introduction duct 42*a* and the bottom surface of the inner casing 11*a* toward the second evaporator 22.

Next, the refrigerator 1 according to the embodiment of the present disclosure may include the second duct.

The second duct may be formed as at least one of a passage (e.g., a tube such as a duct or a pipe, etc.), a hole, and an air flow path which guides air around the evaporator 21 or 22 to be moved to the storage compartment.

The second duct may include the fan duct assembly 30 and 40 located in front of the evaporator 21 and 22.

As illustrated in FIGS. 1 and 2, the fan duct assembly 30 and 40 may include at least one fan duct assembly of a first fan duct assembly 30 which guides the flow of cold air in the first storage compartment 12 and the second fan duct assembly 40 which guides the flow of cold air in the second storage compartment 13.

In this case, space between the fan duct assemblies 30 and 40 of the inside of the inner casing 11*a* in which the evaporators 21 and 22 are respectively located and the rear wall surface of the inner casing 11*a* may be defined as a heat exchange flow path in which fluid exchanges heat with the evaporators 21 and 22.

Of course, although not shown, even if a evaporator is provided only in one of the storage compartments, the fan duct assemblies 30 and 40 may be provided in the storage compartments 12 and 13, respectively, and even if the evaporators 21 and 22 are provided in the storage compartments 12 and 13, respectively, only one of the fan duct assemblies 30 and 40 may be provided. Various configurations are possible.

Meanwhile, in the embodiment described below, for example, the cold air generation structure of the cold air source may be the cooling source (second evaporator 22), the cold air supply structure of the cold air source may be the second cooling fan 41, the first duct may be the introduction duct 42*a* formed in the second fan duct assembly 40, and the second duct may be the second fan duct assembly 40.

As illustrated in FIGS. 7 to 12, the second fan duct assembly 40 may include a grille panel 42.

The grille panel 42 may have the introduction duct 42*a* into which fluid is introduced from the second storage compartment 13. As described above, the introduction duct 42*a* may constitute the first duct together with the rear bottom surface of the inner casing 11*a*, and may be formed to protrude from the lower end of the grille panel 42 toward the inside of the second storage compartment 13.

Particularly, the introduction duct 42*a* may be formed to decline gradually toward a front side. The inclination of the introduction duct 42*a* may be similar to or equal to the inclination defined on the rear bottom surface of the inside of the inner casing 11*a* due to a machine room.

That is, fluid in the second storage compartment 13 may flow to the second evaporator 22 through the introduction flow path provided between the introduction duct 42*a* constituting the first duct and the inclined bottom surface of the inner casing 11*a*.

The rear bottom surface of the inside of the inner casing 11*a* may be formed to incline upward gradually toward a rear side.

Specifically, the rear bottom surface of the inner casing 11*a* may be configured to have the highest position at a portion in front of the second evaporator 22 and to incline downward gradually after the highest position such that the condensate collector 11*c* is formed to be recessed directly under the second evaporator 22.

As illustrated in FIGS. 7 and FIGS. 9 to 12, the second fan duct assembly 40 may include a shroud 43.

The shroud 43 may be coupled to the rear surface of the grille panel 42. A flow path for guiding the flow of cold air to the second storage compartment 13 may be provided between the shroud 43 and the grille panel 42.

A fluid inflow hole 43*a* may be formed in the shroud 43. That is, after cold air passing through the second evaporator 22 is introduced into the flow path for the flow of cold air located between the grille panel 42 and the shroud 43 through the fluid inflow hole 43*a*, the cold air may pass through each cold air discharge hole 42*b* of the grille panel 42 under the guidance of the flow path and may be discharged into the second storage compartment 13.

The cold air discharge hole 42*b* may include at least two cold air discharge holes. For example, as illustrated in FIG. 9, the cold air discharge hole 42*b* may be formed on each of opposite side portions of the upper, middle, lower parts of the grille panel 42.

The second evaporator 22 may be configured to be located under the fluid inflow hole 43*a*.

Meanwhile, the second cooling fan 41 may be installed in a flow path between the grille panel 42 and the shroud 43.

Preferably, the second cooling fan 41 may be installed in the fluid inflow hole 43*a* formed in the shroud 43. That is, due to the operation of the second cooling fan 41, fluid in the second storage compartment 13 may sequentially pass through the introduction duct 42*a* and the second evaporator 22 and then may be introduced to the fluid inflow hole 43*a* through the flow path.

Next, the refrigerator 1 according to the embodiment of the present disclosure may include a defrosting device 50.

The defrosting device 50 is a device that provides a heat source to remove frost formed on the cooling source (e.g., the second evaporator).

Of course, the defrosting device 50 may perform the function of defrosting the frost detection device 70 to be described later or the function of preventing the freezing of the frost detection device 70.

As illustrated in FIGS. 4, 7, 8, and 14, the defrosting device 50 may include a first heater 51.

That is, heat generated by the first heater 51 may remove frost formed on the second evaporator 22 (the cooling source).

The first heater 51 may be located at a lower side (a fluid inflow side) of the second evaporator 22. That is, heat generated by the first heater 51 may be provided from the lower end of the second evaporator 22 to an upper end thereof in the direction of fluid flow.

Of course, although not shown, the first heater 51 may be located at a side portion of the second evaporator 22, in front of or behind the second evaporator 22, or above the second evaporator 22, or may be located to be in contact with the second evaporator 22.

The first heater 51 may be configured as a sheath heater. That is, frost formed on the second evaporator 22 is removed by using the radiant heat and convection heat of the sheath heater.

As illustrated in FIGS. 4, 7, and 14, the defrosting device 50 may include a second heater 52.

The second heater 52 may be a heater that provides heat to the second evaporator 22 while generating the heat with a lower output than the output of the first heater 51.

The second heater 52 may be located to be in contact with heat exchange fins of the second evaporator 22. That is, the second heater 52 may be in direct contact with the second evaporator 22 so that the second heater 52 may remove frost formed on the second evaporator 22 through heat conduction.

The second heater 52 may be formed as an L-cord heater. That is, frost formed on the second evaporator 22 may be removed by the conduction heat of the L-cord heater.

In this case, the second heater 52 may be installed to be in contact with the heat exchange fins located on the upper portion (a fluid outflow side) of the second evaporator 22.

Meanwhile, the defrosting device 50 may be provided with both the first heater 51 and the second heater 52, or only one of the first heater 51 and the second heater 52.

In addition, the defrosting device 50 may include a temperature sensor for an evaporator (not shown).

The temperature sensor for an evaporator may detect a temperature around the defrosting device 50, and this detected temperature value may be used as a factor determining the turning on/off of each of the heaters 51 and 52.

For example, when a temperature value detected by the temperature sensor for an evaporator reaches a specific temperature (a defrosting end temperature) after each of the heaters 51 and 52 is turned on, each of the heaters 51 and 52 may be turned off.

The defrosting end temperature may be set as an initial temperature, and when remaining ice is detected in the second evaporator 22, the defrosting end temperature may be increased by a predetermined temperature.

Next, the refrigerator 1 according to the embodiment of the present disclosure may include the frost detection device 70.

The frost detection device 70 may be a device which detects the amount of frost or ice formed on the cooling source.

In addition, the frost detection device 70 may recognize the degree of frost formed on the second evaporator 22 by using a sensor which outputs different values according to the physical property of fluid. In this case, the physical property may include at least one of a temperature, pressure, and a flow rate.

The frost detection device 70 may be configured such that the execution time of defrosting operation based on the degree of the recognized frost formation may be accurately known.

FIG. 7 is a sectional view illustrating the installation states of the frost detection device and the evaporator according to the embodiment of the present disclosure, and FIG. 8 is an enlarged view of an "A" part of FIG. 7.

In addition, FIGS. 9 to 12 and 15 illustrate a state in which the frost detection device is installed in the second fan duct assembly, and FIGS. 16 to 28 illustrate the detailed structure of each of components constituting the frost detection device.

The structure of the frost detection device 70 will be described in more detail with reference to these drawings.

Prior to explanation, the frost detection device 70 is located in the flow path of fluid guided by the introduction duct 42*a* (the first duct) and the second fan duct assembly 40 (the second duct) and is a device which detects frost formed on the second evaporator 22 (the cooling source).

The frost detection device 70 may include the frost detection duct 710.

The frost detection duct 710 may provide a flow passage (a flow path) of fluid detected by the frost check sensor 740 for checking frost formed on the second evaporator 22. The frost detection duct 710 may be provided as a portion in which the frost check sensor 740 is located for checking frost formed on the second evaporator 22.

The frost detection duct 710 may include a fluid inlet 711 and a fluid outlet 712.

At least a portion of the frost detection duct 710 may be located in at least one portion of the flow path of fluid circulating through the second storage compartment 13, the introduction duct 42*a*, the second evaporator 22, and the second fan duct assembly 40.

Preferably, at least a portion of the frost detection duct 710 may be disposed in an introduction flow path through which fluid flows toward the cooling source through the first duct.

Specifically, the fluid inlet 711 of the frost detection duct 710 may be formed to be open to the introduction flow path between the introduction duct 42*a* and the fluid inflow side of the second evaporator 22.

That is, some of fluid flowing toward the fluid inflow side of the second evaporator 22 through the introduction duct 42*a* may be introduced through the fluid inlet 711 into a guide flow path 713.

More specifically, as illustrated in FIGS. 7 and 8, the fluid inlet 711 of the frost detection duct 710 may be formed to be directed to a portion between the highest position of the rear bottom surface of the inner casing 11*a* and a portion at which the condensate collector 11*c* is formed to be recessed.

Accordingly, when defrost water flows down to the fluid inlet 711, the defrost water may be collected in the condensate collector 11*c* without flowing to the second storage compartment 13.

In addition, at least a portion of the frost detection duct 710 may preferably be disposed in an outflow path through which fluid flows through the cooling source toward the second duct.

In this case, the outflow path may be a flow path provided such that fluid passes a position between the fluid outflow side of the second evaporator 22 and the fluid inflow hole 43*a* of the shroud 43.

Specifically, the fluid outlet 712 of the frost detection duct 710 may be formed to be open toward the outflow path.

That is, fluid passing through the frost detection duct 710 through the fluid outlet 712 may flow to a position between the fluid outflow side of the second evaporator 22 and the fluid inflow hole 43*a* of the shroud 43.

Meanwhile, the frost detection duct 710 may be configured to guide a fluid flow separate from the flow of fluid passing through the second evaporator 22 and the flow of fluid flowing through the second fan duct assembly 40.

To this end, the frost detection duct 710 may include the guide flow path 713 (see FIGS. 13, 18, and 20).

The guide flow path 713 may be a part formed to guide the flow of fluid introduced into the frost detection duct 710 through the fluid inlet 711.

The guide flow path 713 may be formed in the rear surface of the grille panel 42 (a surface facing the second evaporator) by being recessed therefrom such that the rear surface of the guide flow path 713 is open.

Particularly, the upper and lower surface of the guide flow path 713 may be formed to be open, and accordingly, the guide flow path 713 may provide a flow path through which fluid flows by opposite side wall surfaces and a bottom surface (a surface of a recessed side, a front surface).

In this case, the open lower surface of the guide flow path 713 may be provided as the fluid inlet 711 as illustrated in FIG. 18.

As illustrated in FIG. 9, a portion at which the guide flow path 713 is formed may protrude forward from the grille panel 42. That is, the portion of the guide flow path 713 may be formed by protruding forward from the grille panel 42 as much as depth at which the guide flow path 713 is recessed such that the thickness of the grille panel 42 may be maintained to be constant.

Installation grooves 714 in which the opposite ends of the frost check sensor 740 are installed may be formed respectively in the internal opposite side wall surfaces of the guide flow path 713 by being recessed therefrom.

Particularly, the guide flow path 713 may be formed vertically. That is, the guide flow path 713 may have a vertical structure without bending so as to reduce resistance to the flow of fluid flowing along the guide flow path 713.

In addition, as illustrated in FIG. 16, and FIGS. 18 to 20, the frost detection duct 710 may include a fluid exit part 717.

The fluid exit part 717 may be a part formed to guide the discharging of fluid flowing along the guide flow path 713 to the fluid outlet 712.

The fluid exit part 717 may be formed on the inclined part of the shroud 43 and may have opposite side wall surfaces, a bottom surface, and an upper surface, and each of the lower surface and rear surface of the fluid exit part 717 may be configured as an open recessed part.

In this case, a portion of the open rear surface of the fluid exit part 717 may be provided as the fluid outlet 712.

Particularly, a mounting protrusion part 717*a* may be formed on the fluid exit part 717.

The mounting protrusion part 717*a* may protrude downward from a portion at which fluid flow into the fluid exit part 717 and may be configured to be recessed in the guide flow path 713 formed in the grille panel 42.

That is, the mounting protrusion part 717*a* of the fluid exit part 717 may be formed to be recessed in the guide flow path 713, and thus when moisture such as defrost water or condensate is introduced to the fluid outlet 712, the moisture may efficiently flow down without gathering at a connection portion between the fluid exit part 717 and the guide flow path 713.

In the rear surface of the shroud 43, a blocking protrusion 717*b* may be formed on the upper side of the fluid exit part 717.

Specifically, the blocking protrusion 717*b* may be formed to block the upper side of the fluid outlet 712.

That is, due to the provision of the blocking protrusion 717*b*, moisture flowing down on the rear surface of the shroud 43 may be prevented from being introduced into the fluid outlet 712.

The blocking protrusion 717*b* may be formed in an upwardly convex round structure (see attached drawings), in an upwardly convex inclined structure, or in a simple linear structure.

In addition, the frost detection device 70 may include a flow path cover 720.

The flow path cover 720 may be installed to cover the open rear surface (a surface facing the second evaporator) of the frost detection duct 710 and may function to separate the internal flow path of the frost detection duct 710 from an external environment.

In this case, the upper end of the flow path cover 720 may be formed to cover a remaining portion except for the fluid outlet 712 of the fluid exit part 717 constituting the frost detection duct 710.

Accordingly, the fluid outlet 712 may be open to the outside, and fluid provided to the fluid exit part 717 through the guide flow path 713 may be discharged through the fluid outlet 712. This is illustrated in FIG. 21.

As illustrated in FIGS. 21 to 25, at least a portion of the flow path cover 720 may be formed to be inclined (or curved).

That is, when it is considered that the fluid exit part 717 is formed on the inclined surface of the shroud 43, a portion of the flow path cover 720 for covering a portion of the fluid exit part 717 may also be formed to be bent having the same inclination (or curve) as the inclined surface of the shroud 43.

The rear surface (a surface facing the second evaporator) of the flow path cover 720 may be configured to be located in the same plane (flush) as the rear surface (a surface facing the second evaporator) of the grille panel 42.

To this end, a placing jaw 42*c* in which the flow path cover 720 is received and placed may be formed to be recessed in a portion in which the guide flow path 713 of the grille panel 42 is formed to be recessed.

As illustrated in FIGS. 13, 18, and 20, the placing jaw 42*c* may be recessed from the rear surface of the grille panel 42 as much as the thickness of the flow path cover 720.

A first coupling part 721 may be formed on the upper end of the flow path cover 720.

In this case, the first coupling part 721 may be coupled to and restrained in a coupling hole 717*c* formed in the fluid exit part 717.

In addition, the frost detection device 70 may be provided with a fluid introduction part 730.

The fluid introduction part 730 may extend downward from the lower end of the flow path cover 720, and may have peripheral wall surfaces. The fluid introduction part 730 may be formed as a tubular body having open upper and lower surfaces.

At least a portion of the fluid introduction part 730 may be received in the lower end portion of the inside of the guide flow path 713 constituting the frost detection duct 710, and the open lower surface of the fluid introduction part 730 may be disposed to be exposed to the introduction flow path (a flow path through which fluid flows through the first duct to the cooling source).

Particularly, as illustrated in FIGS. 8 and 25, a seating recess 713*b* may be formed on the lower end of the inside of the guide flow path 713 by being recessed therefrom, and the fluid introduction part 730 may be seated and installed in the seating recess 713*b*.

Accordingly, the fluid introduction part 730 may be placed in an accurate position.

In this case, as illustrated in FIG. 8, the depth of the seating recess 713*b* may be equal to the thickness of each of the peripheral wall surfaces of the fluid introduction part 730.

That is, through the structure of the seating recess 713*b* having the depth equal to the thickness of the peripheral wall surface of the fluid introduction part 730, the internal flow path of the fluid introduction part 730 and the inner surface of the guide flow path 713 of the inside of the frost detection duct 710 may be connected to each other while forming the same plane.

A connection portion between the internal flow path of the fluid introduction part 730 and the inner surface of the guide flow path 713 may be formed to be partially inclined.

That is, as illustrated in FIG. 8, the inner surface of the lower end of the guide flow path 713 may be formed to expand gradually downward, and the inner surface of the upper end of the fluid introduction part 730 may be formed to expand gradually upward.

Accordingly, moisture such as defrost water flowing down along the guide flow path 713 may be prevented from gathering and freezing in the installation portion of the fluid introduction part 730.

The open upper surface of the fluid introduction part 730 may be installed to match the fluid inlet 711 in the guide flow path 713.

In this case, the inner surface of the upper end of the fluid introduction part 730 may be formed to expand gradually upward such that defrost water may be prevented from gathering in the associated portion.

Meanwhile, the fluid introduction part 730 may be formed to have a front wall 731 and a rear wall 732.

The front wall 731 of the fluid introduction part 730 may be a wall surface facing the bottom part surface of the inside of the guide flow path 713, and the rear wall 732 may be a wall surface facing the cooling source.

A second coupling part 731*a* may be formed on the front wall 731 of the fluid introduction part 730.

The second coupling part 731*a* may be formed to have at least one hook structure protruding forward from the front surface of the front wall 731 constituting the fluid introduction part 730, and in this case, the seating recess 713*b* of the guide flow path 713 may have a fitting recess 713*a* to which the second coupling part 731*a* having the hook structure is fitted and coupled.

The internal flow path of the fluid introduction part 730 may be formed to incline to have an inner width decreasing gradually downward from the guide flow path 713 in the frost detection duct 710.

That is, due to additional provision of the inclined structure described above, fluid passing through the guide flow path 713 may not gather in the fluid introduction part 730 and may efficiently flow down and be discharged.

Particularly, the fluid introduction part 730 may be formed to incline such that the front wall 731 constituting the fluid introduction part 730 is inclined rearward gradually downward.

That is, due to the inclined structure of the front wall 731 described above, defrost water flowing down in the fluid introduction part 730 may pass the highest position of the bottom part surface of the rear side of the inner casing 11*a* and may efficiently flow down toward a portion at which the condensate collector 11*c* is formed.

The open lower surface of the fluid introduction part 730 may be located at the introduction flow path through which fluid flows through the first duct to the cooling source.

Accordingly, some of fluid passing through the introduction flow path may be introduced through the open lower surface of the fluid introduction part 730 into the fluid introduction part 730.

In FIGS. 7, 8, 26, and 27, a state in which the fluid introduction part 730 according to the embodiment of the present disclosure is applied is illustrated.

As illustrated in these drawings, in the fluid introduction part 730 according to the embodiment of the present disclosure, the lower surface of the fluid introduction part 730 may be located in the same plane as the bottom part surface of the introduction duct 42*a* (the first duct).

That is, all portions of the peripheral surfaces of the fluid introduction part 730 may be formed to be received in the guide flow path 713, and in this case, the open lower surface of the fluid introduction part 730 may be located to be exposed to the introduction flow path located under fluid introduction part 730.

The non-protruding structure of the fluid introduction part 730 may preferably have an interference part in the introduction flow path.

In this case, the lower surface of the fluid introduction part 730 may be formed to have the same inclination as the bottom surface of the introduction duct 42*a*.

In FIGS. 28 to 31, a state in which the fluid introduction part 730 according to another embodiment of the present disclosure is applied is illustrated.

As illustrated in these drawings, the lower end of the fluid introduction part 730 according to the another embodiment of the present disclosure may be formed by protruding downward from the bottom surface of the introduction duct 42*a*.

That is, the lower end of the fluid introduction part 730 protruding downward from the bottom surface of the introduction duct 42*a* may provide flow resistance to fluid passing through the introduction flow path, and thus when no frost is formed on the second evaporator 22, the amount of fluid introduced into the guide flow path 713 may be reduced as much as possible.

In this case, the lower surface of the lower end of the fluid introduction part 730 exposed to the inside of the introduction flow path may be formed to have the same height at each of the front and rear of the lower surface, and thus the introduction of fluid passing through the introduction flow path into the fluid introduction part 730 may be reduced as much as possible.

In FIGS. 32 to 35, a state in which the fluid introduction part 730 according to still another embodiment of the present disclosure is applied is illustrated.

As illustrated in these drawings, the lower end of the fluid introduction part 730 according to the still another embodiment of the present disclosure may be formed by protruding downward from the bottom surface of the introduction duct 42*a* and the close contact end 736 may be formed on the lower end of the fluid introduction part 730.

In this case, the close contact end 736 may protrude from the lower end of the fluid introduction part 730 toward the bottom surface of the introduction duct 42*a* located in front of the fluid introduction part, and the upper surface of the close contact end 736 may have the same inclination as the bottom surface of the introduction duct 42*a* so as to be in close contact with the bottom surface of the introduction duct 42*a*.

The structure of the fluid introduction part 730 having the close contact end 736 may be applied when receiving a larger amount of fluid compared to the fluid introduction part 730 without the close contact end 736.

In addition, the frost detection device 70 may include the frost check sensor 740.

The frost check sensor 740 is a sensor which measures physical property of fluid passing through the frost detection duct 710. In this case, the physical property may include at least one of a temperature, pressure, and a flow rate.

Particularly, the frost check sensor 740 may be configured to calculate the amount of frost formed on the second evaporator 22 based on the difference of an output value changing according to the physical property of fluid passing through the frost detection duct 710.

That is, based on the difference of an output value checked by the frost check sensor 740, the amount of frost formed on the second evaporator 22 may be used for determining whether the defrosting operation is necessary.

In the embodiment of the present disclosure, for example, the frost check sensor 740 may be a sensor provided to use temperature difference according to the amount of fluid passing through the frost detection duct 710 such that the amount of frost formed on the second evaporator 22 is checked.

That is, as illustrated in FIGS. 17, 18, and 36, the frost check sensor 740 may be provided in a portion of the frost detection duct 710 in which fluid flows, and thus the amount of frost formed on the second evaporator 22 may be checked based on an output value changing according to a fluid flow rate in the frost detection duct 710.

Of course, the output value may be variously determined by the temperature difference, pressure difference, and other characteristic difference.

FIG. 37 illustrates the structure of the frost check sensor 740.

According to the drawing, the frost check sensor 740 may include a sensing inductor. The sensing inductor may be a means for inducing the measurement precision of the sensing element to be improved such that the sensing element may more accurately measure the physical property (or an output value).

The sensing inductor may, for example, be configured as a heating element 741. The heating element 741 is a heating element that generates heat by receiving power.

The frost check sensor 740 may include the sensing element 742. The sensing element 742 may be an element which measures a temperature around the heating element 741. That is, when it is considered that a temperature around the heating element 741 changes according to the amount of fluid passing through the heating element 741 through the frost detection duct 710, this temperature change may be measured by the sensing element 742 and then based on this temperature change, the degree of frost formed on the second evaporator 22 may be calculated.

The frost check sensor 740 may include the sensor printed circuit board (PCB) 743. The sensor PCB 743 may be configured to determine the difference between a temperature detected by the sensing element 742 when the heating element is turned off and a temperature detected by the sensing element 742 when the heating element 741 is turned on.

Of course, the sensor PCB 743 may be configured to determine whether the logic temperature ΔHt is less than or equal to a reference difference value.

For example, when the amount of frost formed on the second evaporator 22 is small, the amount of fluid flowing through the frost detection duct 710 may be small, and in this case, heat generated according to the turning on of the heating element 741 may be cooled relatively little by the flowing fluid. Accordingly, a temperature sensed by the sensing element 742 may increase, and the logic temperature ΔHt may also increase.

On the other hand, when the amount of frost formed in the second evaporator 22 is large, the amount of fluid flowing through the frost detection duct 710 may be large, and in this case, heat generated according to the turning on of the heating element 741 may be cooled relatively much by the flowing fluid. Accordingly, a temperature detected by the sensing element 742 may decrease, and the logic temperature ΔHt may also decrease.

In the end, the amount of frost formed on the second evaporator 22 may be accurately determined according to whether the logic temperature ΔHt is high or low, and based on the amount of frost formed on the second evaporator 22 determined in this manner, the defrosting operation may be performed at accurate time.

That is, when the logic temperature ΔHt is high, it may be determined that the amount of frost formed on the second evaporator 22 is small, but when the logic temperature ΔHt is low, it may be determined that the amount of frost formed on the second evaporator 22 is large.

Accordingly, a reference temperature difference value may be designated and when the logic temperature ΔHt is lower than the designated reference temperature difference value, it may be determined that the defrosting operation of the second evaporator is necessary.

The frost check sensor 740 may further include a sensor housing 744. The sensor housing 744 may function to prevent water flowing down on the inside of the frost detection duct 710 from being in contact with the heating element, the sensing element 742, or the sensor PCB 743.

The opposite side ends of sensor housing 744 may respectively be inserted into and installed in the installation grooves 714 formed in the internal opposite side wall surfaces of the guide flow path 713.

Next, the refrigerator 1 according to the embodiment of the present disclosure may include a controller 80.

The controller 80 may be a device that controls the operation of the refrigerator 1. The controller may be a microprocessor, an electrical logical circuit, etc.

As illustrated in FIG. 4, the controller 80 may check a room temperature and an internal temperature of the refrigerator based on each temperature sensor 1*a* or 1*b*, may control the frost check sensor 740 or receive information sensed by the frost check sensor 740, and may control the defrosting device 50.

For example, the controller 80 may control the amount of supplied cold air to be increased such that the internal temperature of the associated storage compartment may decrease when the internal temperature of each of the storage compartments 12 and 13 is in a dissatisfaction temperature range classified on the basis of the set reference temperature NT which a user sets for the associated storage compartment, and may control the amount of supplied cold air to be decreased when the internal temperature of each of the storage compartments 12 and 13 is in a satisfaction temperature range classified on the basis of the set reference temperature NT.

In addition, the controller 80 may be configured to control the frost detection device 70 to perform a frost detection operation.

To this end, the controller 80 may be configured to perform the frost detection operation for a set period of frost detection time.

The period of frost detection time may be controlled to change according to a temperature value of the room temperature measured by the first temperature sensor 1*a* or a temperature set by a user.

For example, the period of frost detection time may be controlled to be short due to more frequent cooling operation performed as a room temperature increases or a set temperature decreases, but may be controlled to be sufficiently long due to less frequent cooling operations performed as the room temperature decreases or the set temperature increases.

In addition, the controller 80 may control the frost check sensor 740 to operate in a predetermined cycle.

That is, due to the control of the controller 80, the heating element 741 of the frost check sensor 740 may generate heat for a predetermined period of time, and the sensing element 742 of the frost check sensor 740 may detect a temperature immediately after the heating element 741 is turned on and a temperature immediately after the heating element 741 is turned off.

Through this, a minimum temperature and a maximum temperature may be checked after the heating element 741 is turned on, and a temperature difference value between the minimum temperature and the maximum temperature may be maximized, so discrimination power for frost detection may be further improved.

In addition, the controller 80 may be configured to check the temperature difference value ΔHt (a logic temperature) between the turning on and off of the heating element 741 and determine whether the maximum value of the logic temperature ΔHt is less than or equal to a first reference difference value.

In this case, the first reference difference value may be a value set to a degree that defrosting operation is not required to be performed.

Of course, the checking of the logic temperature ΔHt and the comparison of the logic temperature with the first reference difference value may be performed by the sensor PCB 743 constituting the frost check sensor 740.

In this case, the controller 80 may be configured to receive a result value obtained through the checking of the logic temperature ΔHt and the comparison of the logic temperature ΔHt with the first reference difference value performed by the sensor PCB 743 and to control the turning on/off of the heating element 741.

Next, the frost detection operation for detecting the amount of frost formed on the second evaporator 22 of the refrigerator 1 according to the embodiment of the present disclosure will be described.

FIG. 38 is a flowchart of a method of performing defrosting operation by determining time in which defrosting of the refrigerator is required according to the embodiment of the present disclosure, and FIGS. 39 and 40 are views illustrating the change of a temperature measured by the frost check sensor before and when frost is formed on the second evaporator according to the embodiment of the present disclosure.

FIG. 39 illustrates the temperature change of the second storage compartment 13 and the temperature change of the heating element before frost is formed on the second evaporator 22, and FIG. 40 illustrates the temperature change of the second storage compartment and the temperature change of the heating element while frost is formed on the second evaporator (when frost is formed beyond a permissible limit.

As illustrated in these drawings, after previous defrosting operation is completed at S1, the cooling operation of each of the storage compartments 12 and 13 based on the first set reference temperature and the second set reference temperature may be performed by the control of the controller 80 at S110.

In this case, the cooling operation described above may be performed through the operation control of at least any one of the first evaporator 21 and the first cooling fan 31 according to the first operation reference value designated on the basis of the first set reference temperature, and may be performed through the operation control of at least any one of the second evaporator 22 and the second cooling fan 41 according to the second operation reference value designated on the basis of the second set reference temperature.

For example, the controller 80 may control the first cooling fan 31 to operate when the internal temperature of the first storage compartment 12 is in the dissatisfaction temperature range classified on the basis of the first set reference temperature set by a user.

The controller 80 may control the first cooling fan 31 to stop when the internal temperature is in the satisfaction temperature range.

In this case, the controller 80 may selectively open/close each of the refrigerant passages 61 and 62 by controlling the refrigerant valve 63 such that the cooling operation for the first storage compartment 12 and the second storage compartment 13 is performed.

In addition, in the cooling operation for the second storage compartment 13, fluid (cold air) passing through the second evaporator 22 may be provided to the second storage compartment 13 by the operation of the second cooling fan 41, and the fluid circulating in the second storage compartment 13 may flow to the fluid inflow side of the second evaporator 22, and then may repeat the flow of passing through the second evaporator 22 again.

In this case, fluid flowing to the second evaporator 22 from the second storage compartment 13 may be guided by the introduction flow path between the introduction duct 42*a* constituting the second fan duct assembly 40 and the rear bottom surface of the inside of the inner casing 11*a* located at a side opposite to the introduction duct 42*a*.

As illustrated in FIGS. 26 and 27, when the fluid introduction part 730 is a structure which does not protrude into the introduction flow path, fluid flowing along the introduction flow path may efficiently flow without resistance due to the fluid introduction part 730.

As illustrated in FIGS. 28 to 35, when the fluid introduction part 730 is a structure which partially protrudes into the introduction flow path, fluid flowing along the introduction flow path may receive flow resistance due to the fluid introduction part 730.

Accordingly, less fluid may be introduced in the structure of the fluid introduction part 730 which partially protrudes into the introduction flow path than in the structure of the fluid introduction part 730 which does not protrude into the introduction flow path, and thus greater discrimination power to determine physical property of fluid by the frost check sensor 740 may be obtained.

Of course, the structure of the fluid introduction part 730 which does not protrude into the introduction flow path may provide an advantage that no interference occurs even if various structures are present in the associated portion.

The fluid outlet 712 of the frost detection duct 710 may be disposed at a position (a position considering a separation distance from the second cooling fan) in consideration of the influence of pressure generated by the operation of the second cooling fan 41 as well as in consideration of pressure difference between the fluid outlet 712 and the fluid inlet 711.

Accordingly, fluid passing through the frost detection duct 710 may be less influenced by pressure caused by the second cooling fan 41, and some of the fluid may be forced to flow due to the pressure difference between the fluid outlet 712 and the fluid inlet 711 despite the absence of frost on the second evaporator, and accordingly, minimum discrimination power (temperature difference between temperatures before and after frost is formed) for detecting frost may be obtained.

In addition, during the normal cooling operation described above, it may be continuously checked whether a cycle for performing the frost detection operation has been reached at S120.

In this case, the cycle of performing the frost detection operation may be a cycle of time or may be a cycle in which a specific component or the same operation such as an operation cycle is repeatedly performed.

In the embodiment of the present disclosure, the cycle may be a cycle in which the second cooling fan 41 operates.

The frost detection device 70 may be configured to check the amount of frost formed on the second evaporator 22 on the basis of the temperature difference value ΔHt (the logic temperature) according to the change of the flow rate of fluid passing through the guide flow path 713.

In consideration of this, as the logic temperature ΔHt increases, the reliability of a detection result by the frost detection device 70 may be secured. Accordingly, the largest logic temperature ΔHt may be obtained when the second cooling fan 41 operates.

The second cooling fan 41 of the second fan duct assembly 40 may operate when the first cooling fan 31 of the first fan duct assembly 30 stops. Of course, when required, the second cooling fan 41 may be controlled to operate even when the first cooling fan 31 does not completely stop.

The heating element 741 may be controlled to generate heat at the same time in which power is supplied to the second cooling fan 41, immediately after power is supplied to the second cooling fan 41, or when a predetermined condition is satisfied in a state in which power is supplied to the second cooling fan 41.

In the embodiment of the present disclosure, as an example, the heating element 741 is controlled to generate heat when a predetermined heating condition is satisfied in a state in which power is supplied to the second cooling fan 41.

That is, when a cycle for the frost detection operation has been reached, the heating condition of the heating element 741 may be checked at S130, and when the heating condition is satisfied, the heating element 741 may be controlled to generate heat.

The heating condition may include at least any one condition of a condition in which the heating element is automatically controlled to generate heat when a predetermined period of time elapses after the operation of the second cooling fan 41, a condition in which the internal temperature of the guide flow path 713 (a temperature checked by the sensing element) gradually decreases before the operation of the second cooling fan 41, a condition in which the second cooling fan 41 is operating, and a condition in which the door of the second storage compartment 13 is not opened.

In addition, when it is checked that the heating condition as described above is satisfied, the heating element 741 may generate heat at S140 under the control of the controller 80 (or the control of the sensor PCB).

In addition, when heating of the heating element 741 is performed, the sensing element 742 may detect the physical property of fluid in the guide flow path 71, that is, a temperature Ht1 of the fluid at S150.

The sensing element 742 may detect the temperature Ht1 simultaneously with the heating of the heating element 741, or may detect the temperature Ht1 immediately after the heating of the heating element 741 is performed.

Particularly, the temperature Ht1 detected by the sensing element 742 may be the lowest temperature of the inside of the guide flow path 713 that is checked after the heating element 741 is turned on.

The detected temperature Ht1 may be stored in the controller 80 (or the sensor PCB).

In addition, the heating of the heating element 741 may be performed during the set period of heating time. In this case, the set period of heating time may be enough period of time to discriminate the change of the internal temperature of the guide flow path 713.

For example, when the heating element 741 generates heat for the set period of heating time, discrimination power may be obtained except for the logic temperature ΔHt due to other factors predicted or unpredicted.

The set period of heating time may be a specific period of time or may be a period of time that varies according to a surrounding environment.

In addition, when the set period of heating time elapses, power supply to the heating element 741 may be cut off and heat generation by the heating element 741 may stop at S160.

Of course, even if the period of heating time does not elapse, power supply to the heating element 741 may be controlled to be stopped.

When the heating of the heating element 741 stops, the physical property of fluid, that is, a temperature Ht2 of the fluid in the guide flow path 713 may be detected by the sensing element 742 at S170.

In this case, temperature detection by the sensing element 742 may be performed at the same time in which the heating of the heating element 741 stops, or immediately after the heating of the heating element 741 stops.

Particularly, the temperature Ht2 detected by the sensing element 742 may be a maximum internal temperature of the guide flow path 713 checked before and after the heating element 741 is turned off.

The detected temperature Ht2 may be stored in the controller 80 (or the sensor PCB).

In addition, the controller 80 (or the sensor PCB) may calculate the logic temperature ΔHt between detected temperatures Ht1 and Ht2 on the basis of the detected temperatures Ht1 and Ht2, and on the basis of the calculated logic temperature ΔHt, to determine whether to perform defrosting operation for the cooling source 22 (the second evaporator).

That is, after the difference value ΔHt between the temperature Ht1 during the heating of the heating element 741 and the temperature Ht2 during the end of the heating of the heating element 741 is calculated and stored at S180, whether to perform the defrosting operation may be determined based on the logic temperature ΔHt.

For example, when the logic temperature ΔHt is higher than a set first reference difference value, a fluid flow rate in the guide flow path 713 may be low, and thus it may be determined that the amount of frost formed on the second evaporator 22 is small to a degree that the defrosting operation is not performed.

That is, when the amount of frost formed on the second evaporator 22 is small, pressure difference between the air inflow side and fluid outflow side of the second evaporator 22 may be low, and the flow rate of fluid flowing in the guide flow path 713 may be low, so the logic temperature ΔHt may be relatively high.

On the other hand, when the logic temperature ΔHt is lower than a set second reference difference value, a fluid flow rate in the guide flow path 713 may be high, and thus it may be determined that the amount of frost formed in the second evaporator 22 requires the performance of defrosting operation.

That is, when the amount of frost formed on the second evaporator 22 is large, pressure difference between the air inflow side and fluid outflow side of the second evaporator 22 may be high, and due to this pressure difference, the flow rate of fluid flowing in the guide flow path 713 may be high, so the logic temperature ΔHt may be relatively low.

In this case, the second reference difference value may be a value set to such an extent that the defrosting operation is required to be performed. Of course, the first reference difference value and the second reference difference value may be the same value, and the second reference difference value may be set as a value smaller than the first reference difference value.

Each of the first reference difference value and the second reference difference value may be one specific value or a value of a range.

For example, the second reference difference value may be 24° C., and the first reference difference value may be a temperature between 24° C. and 30° C.

In addition, as a result of the comparison of the logic temperature with each of the reference difference values described above, when the logic temperature ΔHt checked by the controller 80 is higher than the set first reference difference value (for example, 24° C. to 30° C.), it may be determined that the amount of frost formed on the second evaporator 22 is less than the set amount of frost for performance of defrosting operation.

In this case, after the second cooling fan 41 stops, frost detection may stop until the second cooling fan 41 operates in a next cycle.

Next, when the operation of the second cooling fan 41 of the next cycle is performed, the process of determining whether the heating condition for the frost detection described above is satisfied may be repeatedly performed.

On the other hand, when the logic temperature ΔHt checked by the controller 80 is lower than the set second reference difference value (e.g., 24° C.), it may be determined that the second evaporator 22 has frost more than the set amount of frost, and thus defrosting operation may be controlled to be performed at S2.

In this case, during the defrosting operation, a stored logic temperature ΔHt for each frost detection cycle may be reset.

Next, the process S2 of performing the defrosting operation for the second evaporator 22 of the refrigerator according to the embodiment of the present disclosure will be described.

First, after the heating element 741 is turned off, the defrosting operation may be performed according to the determination of the controller 80.

During the defrosting operation, the first heater 51 constituting the defrosting device 50 may generate heat.

That is, heat generated by the first heater 51 may remove frost formed on the second evaporator 22.

In this case, when it is considered that the first heater 51 is configured as the sheath heater, heat generated by the first heater 51 may remove frost formed on the second evaporator 22 through radiation and convection.

In addition, during the defrosting operation, the second heater 52 constituting the defrosting device 50 may generate heat.

That is, heat generated by the second heater 52 may remove frost formed on the second evaporator 22.

In this case, when the second heater 52 is configured as the L-cord heater, heat generated by the second heater 52 may be conducted to the heat exchange fins of the second evaporator 22 and remove frost that has formed on the second evaporator 22.

The first heater 51 and the second heater 52 may be controlled to simultaneously generate heat, or after the first heater 51 first generates heat, the second heater 52 may be controlled to generate heat, or after the second heater 52 first generates heat, the first heater 51 may be controlled to generate heat.

In addition, after the first heater 51 or the second heater 52 generates heat for a set period of time, the heating of the first heater 51 or the second heater 52 may stop.

In this case, even if the first heater 51 and the second heater 52 provide heat together, the two heaters 51 and 52 may simultaneously stop heating thereof, or after any one heater first stop heating, the other heater may be controlled to stop heating.

A period of time set for heating of each of the heaters 51 and 52 may be set as a specific period of time (e.g., one hour), or may be set as a period of time changing according to the amount of formed frost.

In addition, the first heater 51 or the second heater 52 may operate with a maximum load, and may operate with a load changing according to the amount of defrosting.

Additionally, when the defrosting operation is performed according to the defrosting device 50 described above, the heating element 741 constituting the frost check sensor 740 may also be controlled to generate heat.

That is, when it is considered that water generated due to frost melted during the defrosting operation may flow down into the guide flow path 713, the heating element 741 may also generate heat such that the water does not freeze in the guide flow path 713.

In addition, the defrosting operation may be performed based on time or a temperature.

That is, the defrosting operation may be controlled to end when the defrosting operation is performed for a certain period of time, and when the temperature of the second evaporator 22 reaches a set temperature.

In addition, when the operation of the defrosting device 50 described above is completed, the first cooling fan 31 may operate with a maximum load such that the first storage compartment 12 reaches a set temperature range, and then the second cooling fan 41 may operate with a maximum load such that the second storage compartment 13 reaches a set temperature range.

In this case, during the operation of the first cooling fan 31, a refrigerant compressed from the compressor 60 may be controlled to be provided to the first evaporator 21, and during the operation of the second cooling fan 41, a refrigerant compressed from the compressor 60 may be controlled to be provided to the second evaporator 22.

In addition, when a temperature condition of each of the first storage compartment 12 and the second storage compartment 13 is in the satisfied condition, the above-described control for detecting the formation of frost in the second evaporator 22 performed by the frost detection device 70 may be sequentially performed again.

Of course, it may be more preferable that by detecting residual ice immediately after the operation of the defrosting device 50 is completed, it is determined whether to perform additional defrosting operation.

That is, when residual ice is checked, additional defrosting operation may be performed even if time for the defrosting operation has not been reached, and thus the residual ice may be completely removed.

The defrosting operation is not limited to being performed based on information acquired by the frost detection device 70.

For example, the defrosting operation may be performed when the door of any one storage compartment is opened (slightly opened) for a long period of time due to a user's carelessness.

This may be recognized through a sensor which detects the opening of the door, and in this case, without operating the frost detection device 70, after a predetermined period of time elapses, the defrosting operation may be set to be performed forcibly.

In addition, when the frost detection operation is not performed periodically due to excessively frequent opening and closing of a door, without using the information obtained by the frost detection device 70, the defrosting operation may be set to be forcibly performed at time set in consideration of the frequent opening and closing of the door.

Meanwhile, while the defrosting operation described above is performed, ice formed on the second evaporator 22 and ice formed in the fluid inflow hole 43*a* of the shroud 43 or the surrounding thereof (e.g., the second cooling fan, etc.) may be melted by indirectly receiving heat of the second heater 52.

In this case, some of defrost water melted down from the fluid inflow hole 43*a* of the shroud 43 or the surrounding thereof (e.g., the second cooling fan, etc.) may be introduced through the fluid outlet 712 of the fluid exit part 717 into the guide flow path 713.

Ice formed in the inside of the guide flow path 713 or the fluid exit part 717 constituting the frost detection duct 710 may be melted down by heat of the second heater 52 and heat of the heating element 741.

In addition, defrost water flowing along the inside of the guide flow path 713 may pass the frost check sensor 740 and may pass through the internal flow path of the fluid introduction part 730 located to communicate with the guide flow path 713, and then may flow through the fluid inlet 711 to the introduction flow path.

In this case, when it is considered that the front wall 731 of the fluid introduction part 730 is formed to incline rearward gradually toward a lower side, defrost water introduced into the fluid introduction part 730 may more efficiently flow downward without becoming stagnant in an associated portion.

Particularly, the inclination may be configured to be directed to a portion in which the condensate collector 11*c* is formed past the highest position of the bottom surface of the rear of the inner casing 11*a*, and thus defrost water flowing down through the fluid introduction part 730 does not flow down to the second storage compartment 13, but may flow down toward the condensate collector 11*c*.

Furthermore, when the defrosting operation described above is completed, the above-described cooling operation may be performed again at S110, and subsequently, the frost detection operation for frost detection may be performed again.

Of course, it is possible to check at least any one of whether residual frost is present, whether the sensing element 742 has failed, and whether the guide flow path 713 is blocked by using a logic temperature checked during re-performance of the frost detection operation after the defrosting operation is completed.

Finally, in the refrigerator of the present disclosure, the width of the flow path of the inside of the fluid introduction part 730 and the flow path of the inside of the guide flow path 713 may be the same, and thus moisture flowing down in the guide flow path 713 may not be stagnant or gathered between the guide flow path 713 and the internal flow path of the fluid introduction part 730, but may be efficiently discharged, thereby preventing freezing in an associated portion.

In addition, in the refrigerator of the present disclosure, the front wall 731 of the fluid introduction part 730 may be formed to incline rearward gradually toward a lower side, and thus defrost water flowing down into the fluid introduction part 730 through the guide flow path 713 does not stay in an associated portion, but may more efficiently flow downward.

Particularly, the inclination may be directed to a portion at which the condensate collector 11*c* is formed past the highest position of the rear bottom surface of the inner casing 11*a*, and thus defrost water flowing down through the fluid introduction part 730 may flow down toward the condensate collector 11*c*. Accordingly, defrost water may be prevented from flowing down into the second storage compartment 13.

In addition, in the refrigerator of the present disclosure, any one of a plurality of flow path covers 720 having fluid introduction parts 730 formed in different structures may be selectively provided, and thus an optimal fluid introduction part 730 according to the structure or purpose of the introduction flow path may be provided.

The invention claimed is:

1. A refrigerator comprising:

a casing which provides a storage compartment;

an evaporator which cools fluid supplied to the storage compartment;

a grille panel arranged between the storage compartment and the evaporator;

a shroud arranged between the grille panel and the evaporator and coupled to the grille panel;

a fan installed between the grille panel and the shroud;

a frost detection device configured to detect an amount of frost or ice generated on the evaporator;

an inlet duct formed at a lower portion of the grille panel and guiding air from the storage compartment to evaporator, wherein the inlet duct is positioned to be spaced apart above a bottom surface of the casing and provides a flow path such that the fluid flows between the inlet duct and the bottom surface of the casing toward the evaporator, wherein the frost detection device comprises:

a guide flow path formed by recessing a surface of the grille panel facing the evaporator and having openings of upper and lower surfaces;

a flow path cover covering the guide flow path to separate the guide flow path from the evaporator;

a frost check sensor provided in the guide flow path; and a fluid introduction part provided on a lower end of the flow path cover and having peripheral wall surfaces and openings of upper and lower surfaces, wherein an upper end of the fluid introduction part connects to a lower end of the guide flow path, wherein the lower surface of the fluid introduction part opens toward the flow path between the inlet duct and the bottom surface of the casing, wherein an inner surface of the upper end of the fluid introduction part forms to expand gradually downward, wherein an inner surface of a lower end of the guide flow path forms to expand gradually upward, and wherein a seating recess forms at the inner surface of the lower end of the guide flow path, and the fluid introduction part is seated in the seating recess, and wherein an outlet of the fluid introduction part and an inlet of the guide flow path have same size.

2. The refrigerator of claim 1, wherein a front wall of the fluid introduction part is formed to incline rearward gradually downward.

3. The refrigerator of claim 1, wherein the shroud further includes a fluid exit part defining an outlet of the guide flow path, wherein the fluid exit part is formed by recessing a surface facing the evaporator of the shroud and connects to an upper end of the guide flow path, and wherein the flow path cover covers at least a portion of the fluid exit part.

4. The refrigerator of claim 1, wherein the frost check sensor of the frost detection device is configured to measure a physical property of the portion of the fluid passing through the frost detection duct, and the physical property comprises at least one of a temperature, pressure, and a flow rate.

5. The refrigerator of claim 1, wherein the frost check sensor comprises a sensor and a sensing inductor.

6. The refrigerator of claim 5, wherein the sensing inductor is means for inducing the sensor to improve precision of measuring a physical property of fluid.

7. The refrigerator of claim 5, wherein the sensing inductor comprises a heater which generates heat.

8. The refrigerator of claim 1, wherein the refrigerator comprises a refrigerant valve which controls an amount of a refrigerant supplied to the evaporator.

9. The refrigerator of claim 1, wherein the refrigerator comprises a compressor which compresses a refrigerant supplied to the evaporator.

10. The refrigerator of claim 1, wherein the refrigerator comprises a cooling fan which operates to circulate the fluid around the evaporator to the storage compartment.

11. The refrigerator of claim 1, wherein an internal flow path of the fluid introduction part is inclined to have an inner width decreasing gradually downward from an internal flow path of the frost detection duct.

12. The refrigerator of claim 1, wherein a depth of the seating recess corresponds to the peripheral wall surfaces of the fluid introduction part.

13. The refrigerator of claim 1, wherein the fluid introduction part is inclined downward gradually forward by protruding from a lower end of the grille panel toward the inside of the storage compartment, and the lower surface of the fluid introduction part is located on a same surface as a bottom surface of the fluid introduction part.

14. The refrigerator of claim 13, wherein the lower surface of the fluid introduction part has a same inclination as the inclination of the fluid introduction part.

15. A refrigerator comprising:

a casing which provides a storage compartment;

an evaporator which cools fluid supplied to the storage compartment;

a grille panel arranged between the storage compartment and the evaporator;

a shroud arranged between the grille panel and the evaporator and coupled to the grille panel;

a fan installed between the grille panel and the shroud;

a frost detection device which detects an amount of frost or ice formed on the evaporator;

an inlet duct formed at a lower portion of the grille panel and guiding air from the storage compartment to evaporator;

wherein the inlet duct is positioned to be spaced apart above a bottom surface of the casing and provides a flow path such that the fluid flows between the inlet duct and the bottom surface of the casing toward the evaporator, wherein the frost detection device comprises:

a guide flow path formed by recessing a surface of the grille panel facing the evaporator and having openings of upper and lower surfaces;

a flow path cover covering the guide flow path to separate the guide flow path from the evaporator; and a frost check sensor provided in the guide flow path, a fluid introduction part provided on a lower end of the flow path cover having peripheral wall surfaces and openings of upper and lower surfaces, wherein the fluid introduction part is inclined downward gradually forward by protruding from a lower end of the grille panel toward the inside of the storage compartment, and a lower end of the fluid introduction part protrudes downward from a bottom surface of the fluid introduction part, and the lower surface of the fluid introduction part is located lower than the bottom surface of the fluid introduction part.

16. The refrigerator of claim 15, wherein the lower surface of the fluid introduction part has a same height at a front and rear of the lower surface.

17. The refrigerator of claim 15, wherein a close contact end is formed on the lower end of the fluid introduction part by protruding therefrom toward the bottom surface of the fluid introduction part located in front of the fluid introduction part, with an upper surface of the close contact end having a same inclination as the bottom surface of the fluid introduction part so as to be adjacent with the bottom surface of the fluid introduction part.

* * * * *